US007860421B2

(12) United States Patent
Kichise et al.

(10) Patent No.: US 7,860,421 B2
(45) Date of Patent: Dec. 28, 2010

(54) IMAGE FORMING APPARATUS

(75) Inventors: Mitsutoshi Kichise, Osaka (JP); Kazuo Mohri, Hyougo (JP)

(73) Assignee: Ricoh Company, Limited, Tokyo (JP)

( * ) Notice: Subject to any disclaimer, the term of this patent is extended or adjusted under 35 U.S.C. 154(b) by 72 days.

(21) Appl. No.: 12/427,281

(22) Filed: Apr. 21, 2009

(65) Prior Publication Data

US 2009/0285594 A1 Nov. 19, 2009

(30) Foreign Application Priority Data

May 14, 2008 (JP) ..... 2008-126636

(51) Int. Cl.
*G03G 15/00* (2006.01)

(52) U.S. Cl. ..... 399/75; 399/12; 399/167

(58) Field of Classification Search ..... 399/12, 399/13, 90, 98, 167, 343, 350
See application file for complete search history.

(56) References Cited

U.S. PATENT DOCUMENTS 6,813,467 B2 * 11/2004 Kawahara et al. ..... 399/353
7,120,376 B2 * 10/2006 Saito et al. ..... 399/167
2007/0189791 A1 8/2007 Mohri

FOREIGN PATENT DOCUMENTS

| | | |
|---|---|---|
| JP | 2004-264553 | 9/2004 |
| JP | 2007-164018 | 6/2007 |
| JP | 2007-199169 | 8/2007 |
| JP | 2008-8927 | 1/2008 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

A process unit is removably attached inside a main body of an image forming apparatus. The process unit includes a casing and a latent image carrier housed inside the casing. The latent image carrier can rotate in a forward direction and a reverse direction. An ID chip is provided in the process unit for storing various information. A communication unit arranged in the main body can communicate with the electronic-information storage unit to write information in or read information from the ID chip. A control unit provides control so that the communication unit does not communicate with the ID chip when the latent image carrier is rotating in the reverse direction.

14 Claims, 11 Drawing Sheets

IMAGE FORMING APPARATUS

CROSS-REFERENCE TO RELATED APPLICATIONS

The present application claims priority to and incorporates by reference the entire contents of Japanese priority document 2008-126636 filed in Japan on May 14, 2008.

BACKGROUND OF THE INVENTION

1. Field of the Invention

The present invention relates to an image forming apparatus, such as a printer, a facsimile machine, and a copier.

2. Description of the Related Art

In image forming apparatuses, residual substance, such as toner or paper dust, that remains on a photosensitive element after image transfer is scraped by a cleaning unit. The cleaning unit includes a cleaning blade with a sharp edge, and the sharp edge of the cleaning blade is pressed against the photosensitive element thereby scraping off the residual substance. With the continued use of the cleaning blade, foreign substances, such as toner or paper dust, are gradually stuck to the edge of the cleaning blade. The foreign substances stuck to the cleaning blade may be caught between the cleaning blade and a surface of the photosensitive element creating various problems. These problems include scattering of toner, generation of image defects such as streak lines in black or white on the image, and causing damage to the photosensitive element.

Japanese Patent Application Laid-open No. 2007-199169, Japanese Patent Application Laid-open No. 2004-264553, and Japanese Patent Application Laid-open No. 2007-164018 disclose techniques to remove foreign substances stuck to the edge portion of a cleaning blade. These conventional techniques teach providing a drive unit capable of driving a photosensitive element to rotate in any of a forward direction and a reverse direction. While the image forming apparatus is not performing image formation, the drive unit drives the photosensitive element to rotate in the reverse direction, i.e., in a direction opposite to a rotating direction when the image forming apparatus performs image formation (i.e., in the forward direction, in this case). When the photosensitive element rotates in the reverse direction it carries the foreign substance stuck to the edge of the cleaning blade.

Furthermore, there has been developed a process unit including an electronic-information storage unit such as an ID chip. The process unit as an image forming unit is removably mounted in an image forming apparatus. Operational information of the process unit and the like are stored in the electronic-information storage unit.

Moreover, there has been developed an image forming apparatus that an openable upper cover is provided on a top end portion of an enclosure of the image forming apparatus so that a process unit can be easily replaced with new one.

How the new process unit is mounted in the image forming apparatus is explained below with reference to FIGS. 10 to 13. FIG. 10 is a side perspective view of an example of a process unit 1Y for yellow. A process unit 1K for black, a process unit 1C for cyan, and a process unit 1M for magenta have substantially identical configuration as that of the process unit 1Y.

As shown in FIG. 10, an ID chip 35Y as an electronic-information storage unit and a plurality of communication electrodes 38Y are provided on a case 13Y of a side surface of the process unit 1Y. The communication electrodes 38Y are connected to respective input-output terminals (not shown) of the ID chip 35Y.

When attaching the process unit 1Y to a main body of the image forming apparatus (hereinafter, "the apparatus main body"), a user drops in the process unit 1Y downward from the upside of the image forming apparatus as shown in FIG. 11.

When the process unit 1Y is completely mounted in the apparatus main body, as shown in FIG. 12, a photosensitive-drum gear 2*b*Y formed on an outer circumferential surface of a back-side flange, which is press-fitted into a back-side end of a photosensitive element 2Y, is engaged with a drive gear 99Y of the apparatus main body, and also the communication electrodes 38Y come in contact with contact electrodes 94Y provided on a back side plate 98 of the apparatus main body.

Furthermore, as shown in FIG. 13, the drive gear 99Y is arranged so that a top portion of the drive gear 99Y is positioned above a bottom portion of the photosensitive-element gear 2*b*Y. Therefore, when the photosensitive element 2Y is driven to rotate in the forward direction, the process unit 1Y is subjected to a force in a vertically downward direction by the engagement between the drive gear 99Y and the photosensitive-element gear 2*b*Y.

The ID chip 35Y stores therein information on a running distance of the photosensitive element 2Y, a remaining amount of toner, an amount of waste toner, and the like. A control unit (not shown) as a communicating unit in the apparatus main body writes information on the ID chip 35Y or reads out information from the ID chip 35Y via a contact between the contact electrodes 94Y and the communication electrodes 38Y while the photosensitive element 2Y is driven to rotate.

However, when the photosensitive element 2Y is driven to rotate in the reverse direction to remove a foreign substance stuck to a cleaning blade, as shown in FIG. 13, the process unit 1Y is subjected to a force in a vertically upward direction. As a result, the process unit 1Y may be uplifted. If the process unit 1Y is uplifted, a contact pressure between the communication electrodes 38Y and the contact electrodes 94Y is reduced, and thus a contact failure may be caused by a vibration of the apparatus. At this time, if the apparatus main body communicates with the ID chip 35Y, a communication error occurs, wrong information is written on the ID chip 35Y, or wrong information is read out from the ID chip 35Y.

SUMMARY OF THE INVENTION

It is an object of the present invention to at least partially solve the problems in the conventional technology.

According to an aspect of the present invention, there is provided an image forming apparatus including a latent image carrier; an image forming unit that is removably attached to a main body of the image forming apparatus, the image forming unit including at least one of a developing unit that develops a latent image on the latent image carrier into a toner image and a cleaning unit that removes transfer residual toner from the latent image carrier, the image forming unit including an electronic-information storage unit that stores therein electronic information; and a conductive member that makes an electrical contact with the main body when the image forming unit is attached to the main body; a drive unit that drives the latent image carrier to rotate in any of a forward direction and a reverse direction; a communicating unit that communicates with the electronic-information storage unit based on an electrical contact between the conductive member and the main body; and a control unit that provides a control so that the communicating does not communicate with the electronic-information storage unit while the latent image carrier is rotating in the reverse direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

As an image forming apparatus according to one embodiment of the present invention, an electrophotographic printer is explained below.

Figure 1:
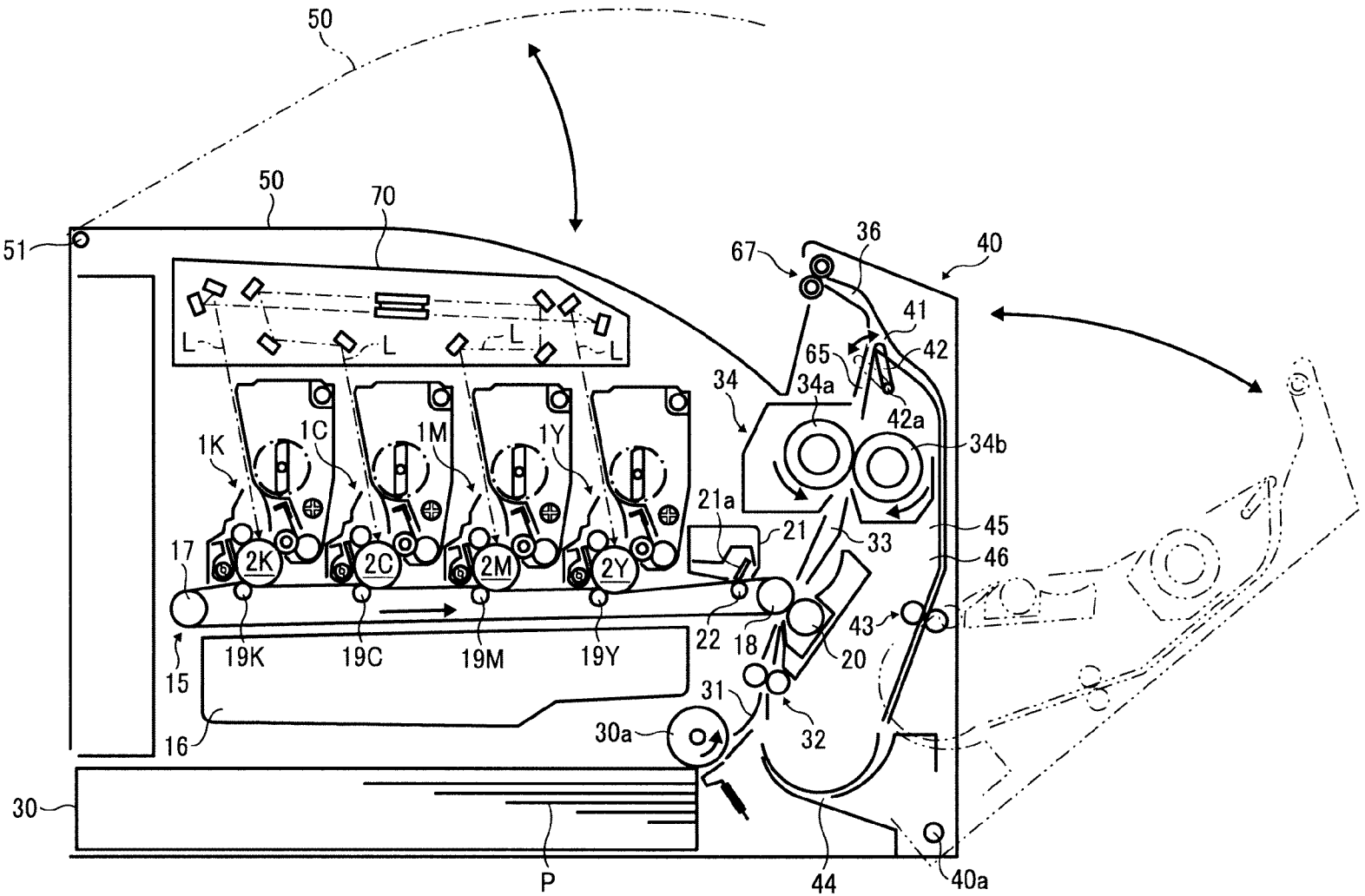
FIG. 1 is a schematic configuration diagram of a printer according to an embodiment of the present invention.
Figure 2:
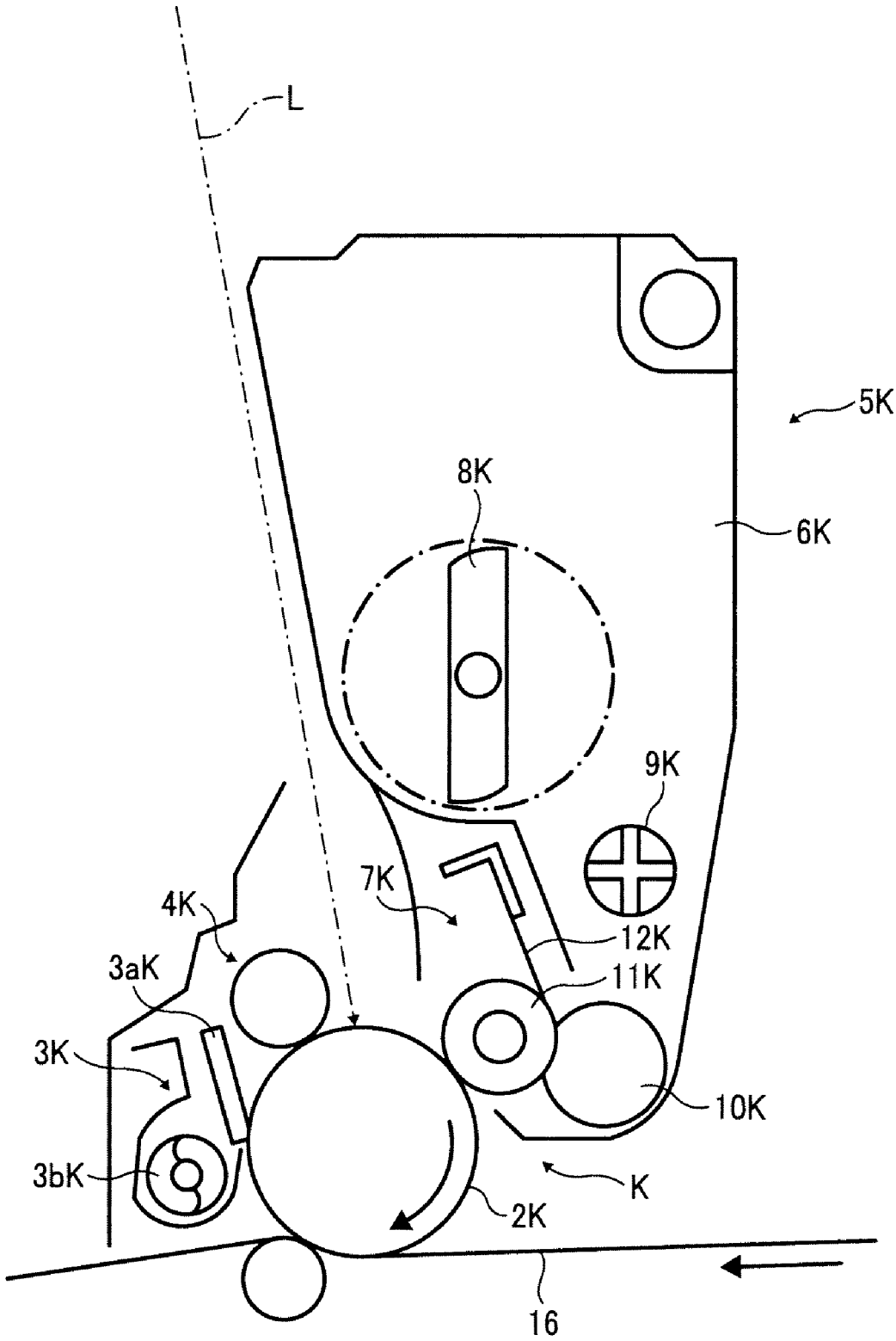
FIG. 2 is an enlarged side view of a black-color process unit included in the printer.

First, a basic configuration of the printer is explained with reference to FIG. 1. FIG. 1 is a schematic configuration diagram of the printer. The printer includes four process units 1Y, 1M, 1C, and 1K. The process units 1Y, 1M, 1C, and 1K respectively form yellow (Y), magenta (M), cyan (C), and black (K) toner images. The process units 1Y, 1M, 1C, and 1K have the same configuration except for color of toner contained therein for forming a toner image. At the end of life, each of the process units 1Y, 1M, 1C, and 1K is individually replaced with new one. To take the process unit 1K for example, as shown in FIG. 2, the process unit 1K includes a photosensitive drum 2K as a latent image carrier, a drum cleaning unit 3K, a neutralization unit (not shown), a charging unit 4K, a developing unit 5K, and the like. The process unit 1K is removably mounted in a main body of the printer so as to be replaced with new one at the end of its life. Namely, when the process unit 1K is replaced with new one, consumable supplies included in the process unit 1K are replaced in a lump.

The charging unit 4K includes a charging roller. The charging roller is pressed against the photosensitive drum 2K. The photosensitive drum 2K has a diameter of 24 millimeters (mm), and is driven to rotate clockwise as indicated by an arrow shown in FIG. 2 at a peripheral speed of 120 mm per second (mm/s) by a drive unit (not shown). The charging roller is applied with a bias current of a direct current (DC) or a bias current that an alternating current (AC) is superimposed on a DC by a high-voltage power supply (not shown) while rotating in accordance with the rotation of the photosensitive drum 2K, and thereby uniformly charging a surface of the photosensitive drum 2K to −500 volts (V). After that, the uniformly-charged surface of the photosensitive drum 2K is exposed to a laser beam L corresponding to K-image data, and a K electrostatic latent image is formed on the surface of the photosensitive drum 2K. The developing unit 5K develops the K electrostatic latent image into a K toner image with K toner (not shown).

The K toner image on the surface of the photosensitive drum 2K is transferred onto an intermediate transfer belt 16 to be described in detail later. The drum cleaning unit 3K includes a cleaning blade 3*a*K, a collection screw 3*b*K, and the like. The cleaning blade 3*a*K is made of a flexible material such as polyurethane rubber. An edge of the cleaning blade 3*a*K is in contact with the surface of the photosensitive drum 2K, and scraps residual toner from the surface of the photosensitive drum 2K after the K toner image is transferred onto the intermediate transfer belt 16. The scrapped toner falls on the collection screw 3*b*K, and conveyed into a waste toner container (not shown) in accordance with rotation of the collection screw 3*b*K. The neutralization unit neutralizes the electric charge remaining on the photosensitive drum 2K after the residual toner is scrapped by the drum cleaning unit 3K. Upon completion of the neutralization of the electric charge, the surface of the photosensitive drum 2K is initialized, and becomes ready for a subsequent toner image formation.

Incidentally, each of the process units 1Y, 1M, and 1C has the same configuration as the process unit 1K, and elements included in each of the process units 1Y, 1M, and 1C are denoted with the same reference numerals as those included in the process unit 1K with suffix of "Y", "M", and "C". In the same manner as the process unit 1K, the process units 1Y, 1M, and 1C respectively form Y, M, and C toner images on the photosensitive drums 2Y, 2M, and 2C, and the Y, M, and C toner images are transferred onto the intermediate transfer belt 16 in a superimposed manner.

In this embodiment, as the developing unit 5K, a monocomponent developing unit is employed. The developing unit 5K includes a vertically-long hopper portion 6K containing therein K toner (not shown) and a developing portion 7K. In the hopper portion 6K, there are provided an agitator 8K, an agitating paddle 9K, a toner supply roller 10K, and the like. The agitator 8K is driven to rotate by a drive unit (not shown). The agitating paddle 9K is arranged below the agitator 8K in a vertical direction, and driven to rotate by a drive unit (not shown). The toner supply roller 10K is arranged below the agitating paddle 9K in the vertical direction, and driven to rotate by a drive unit (not shown). The K toner contained in the hopper portion 6K moves toward the toner supply roller 10K under its own weight while being agitated by the rotation of the agitator 8K and the agitating paddle 9K. The toner supply roller 10K is a roller that a metal cored bar is covered with resin foam or the like. The toner supply roller 10K rotates while attaching the K toner in the hopper portion 6K onto a surface thereof.

In the developing portion 7K, there are provided a developing roller 11K, a thinning blade 12K, and the like. The developing roller 11K is in contact with the photosensitive drum 2K and the toner supply roller 10K, and rotates in accordance with the rotation of the photosensitive drum 2K and the toner supply roller 10K. A tip of the thinning blade 12K is in contact with a surface of the developing roller 11K. The K toner attached onto the surface of the toner supply roller 10K in the hopper portion 6K is supplied to the surface of the developing roller 11K when the K toner comes to a contact portion between the toner supply roller 10K and the developing roller 11K in accordance with the rotation of the toner supply roller 10K. When the K toner supplied to the surface of the developing roller 11K passes through a contact portion between the developing roller 11K and the thinning blade 12K in accordance with the rotation of the developing roller 11K, the K toner is evened out in a predetermined thickness on the surface of the developing roller 11K. The K toner evened out in the predetermined thickness is attached to the K electrostatic latent image on the surface of the photosensitive drum 2K in a developing area, i.e., a contact portion between the developing roller 11K and the photosensitive drum 2K. In this way, the K electrostatic latent image is developed into a K toner image. Incidentally, the present invention is not limited to such a mono-component developing method. Alternatively, a two-component developing method or a non-contact developing method can be employed.

How the process unit 1K forms the K toner image is explained above with reference to FIG. 2. In the same manner as the process unit 1K, the process units 1Y, 1M, and 1C respectively form Y, M, and C toner images on surfaces of the photosensitive drums 2Y, 2M, and 2C.

As shown in FIG. 1, an optical writing unit 70 as a latent-image writing unit is provided above the process units 1Y, 1M, 1C, and 1K in the vertical direction. The optical writing unit 70 includes laser diodes as light sources. The laser diodes emit laser beams L corresponding to Y, M, C, and K images of image data respectively, and optically-scan the photosensitive drums 2Y, 2M, 2C, and 2K in the process units 1Y, 1M, 1C, and 1K. By the laser scanning, Y, M, C, and K electrostatic latent images are formed on the surfaces of the photosensitive drums 2Y, 2M, 2C, and 2K respectively. Incidentally, each of the laser beams L emitted from the laser diodes is deflected in a main-scanning direction by a polygon mirror that is driven to rotate by a polygon motor (not shown), and emitted to the corresponding photosensitive drum 2 via a plurality of optical elements such as an optical lens and an optical mirror.

A transfer unit 15 is provided below the process units 1Y, 1M, 1C, and 1K in the vertical direction. The transfer unit 15 supports the endless intermediate transfer belt 16, and causes the intermediate transfer belt 16 to move counterclockwise in FIG. 1 endlessly. The transfer unit 15 is composed of the intermediate transfer belt 16, a driven roller 18, a drive roller 17, four primary transfer rollers 19Y, 19M, 19C, and 19K, a secondary transfer roller 20, a belt cleaning unit 21, a cleaning backup roller 22, and the like.

The intermediate transfer belt 16 is supported by the driven roller 18, the drive roller 17, the cleaning backup roller 22, and the primary transfer rollers 19Y, 19M, 19C, and 19K that are arranged inside the loop of the intermediate transfer belt 16. The drive roller 17 is driven to rotate counterclockwise in FIG. 1 by a drive unit (not shown). In accordance with the counterclockwise rotation of the drive roller 17, the intermediate transfer belt 16 moves in the same direction endlessly.

The intermediate transfer belt 16 is an endless belt made of a resin film in which a conductive material such as carbon black is dispersed in, for example, polyvinylidine difluoride (PVDF), ethylenetetrafluoroeyhylene (ETFE), poryimide (PI), polycarbonate (PC), thermoplastic elastomer (TPE), or the like. In the present embodiment, the one that has a single layer structure in which carbon black is added to TPE having an elongation modulus of 1000 MPa to 2000 MPa, a thickness of 90 micrometers (μm) to 160 μm, and a width of 230 mm is used as the intermediate transfer belt 16.

Furthermore, as for a resistance of the intermediate transfer belt 16, under environmental conditions of a temperature of 23° C. and a relative humidity of 50%, a volume resistivity is preferably in a range of $10^8$ Ω·cm to $10^{11}$ Ω·cm, and a surface resistivity is preferably in a range of $10^8$ Ω/sq to $10^{11}$ Ω/sq (both measurements are made at an applied voltage of 500 V for an application time of 10 seconds with Hiresta-UP MCP-HT450 manufactured by Mitsubishi Chemical Corporation). When both the volume resistivity and the surface resistivity of the intermediate transfer belt 16 exceed the above ranges, the intermediate transfer belt 16 is charged. Therefore, as the intermediate transfer belt 16 moves toward the downstream side of which the toner images are sequentially transferred onto the intermediate transfer belt 16, a higher voltage needs to be set. Thus, it is difficult for the single high-voltage power supply to supply an appropriate voltage to each of the primary transfer rollers 19Y, 19M, 19C, and 19K. This is because a charged potential of the surface of the intermediate transfer belt 16 is increased by an electric discharge generated in the transfer process or a transfer-medium separating process, so that the intermediate transfer belt 16 has difficulty in a self-discharge. To prevent such a phenomenon, it is necessary to provide a neutralization unit to the intermediate transfer belt 16. On the other hand, when the volume resistivity and the surface resistivity of the intermediate transfer belt 16 drop below the above ranges, a decrease of the charged potential is accelerated, so that the intermediate transfer belt 16 has no difficulty in the self-discharge. However, in this case, a scattering of toner occurs because a current flows in a surface direction when a toner image is transferred onto the intermediate transfer belt 16. Therefore, in the present invention, the volume resistivity and the surface resistivity of the intermediate transfer belt 16 are set to be within the above ranges.

As the drive roller 17, for example, a roller that is made of polyurethane rubber (0.3 mm to 1 mm in thickness) and coated with a thin layer (0.03 mm to 0.1 mm in thickness) can be used. In the present embodiment, a roller (19 mm in diameter) coated with urethane (0.05 mm in layer thickness) is used as the drive roller 17 because a diameter change with the temperature is small.

As the primary transfer rollers 19Y, 19M, 19C, and 19K, a metal roller of diameter 8 mm is used. Each of the primary transfer rollers 19Y, 19M, 19C, and 19K is arranged to be opposed to the corresponding photosensitive drum 2 across the intermediate transfer belt 16 in such a manner that a center axis of the primary transfer roller 19 is shifted from that of the photosensitive drum 2 by 8 mm in a moving direction of the intermediate transfer belt 16, and a top portion of the primary transfer roller 19 is shifted upward by 1 mm from a bottom portion of the photosensitive drum 2 in the vertical direction. By such an arrangement, the endlessly-moving intermediate transfer belt 16 is held between the primary transfer roller 19 and the photosensitive drum 2. Portions of the surface of the intermediate transfer belt 16 between the primary transfer rollers 19Y, 19M, 19C, and 19K and the photosensitive drums 2Y, 2M, 2C, and 2K are referred to as primary transfer nips.

A primary transfer bias of +500 V to +1000 V is applied to each of the primary transfer rollers 19Y, 19M, 19C, and 19K by a transfer-bias power supply (not shown). By the application of the primary transfer bias, a transfer electric field is formed between each of the electrostatic latent images formed on the photosensitive drums 2Y, 2M, 2C, and 2K and each of the primary transfer rollers 19Y, 19M, 19C, and 19K. Incidentally, instead of the primary transfer rollers 19Y, 19M, 19C, and 19K, a transfer charger, a transfer brush, a conductive blade, or a conductive sponge roller can be employed.

When the Y toner image formed on the surface of the photosensitive drum 2Y in the process unit 1Y comes to the primary transfer nip in accordance with the rotation of the photosensitive drum 2Y, the Y toner image is primary-transferred from the photosensitive drum 2Y onto the intermediate transfer belt 16 by the action of the transfer electric field and nip pressure. As the intermediate transfer belt 16 onto which the Y toner image is primary-transferred passes through the other primary transfer nips in accordance with the endless movement, the M, C, and K toner images on the photosensitive drums 2M, 2C, and 2K are sequentially primary-transferred onto the Y toner image on the intermediate transfer belt 16 in a superimposed manner. By the superimposition of the Y, M, C, and K toner images in the primary transfer, a four-color toner image is formed on the intermediate transfer belt 16.

The secondary transfer roller 20 is arranged outside the loop of the intermediate transfer belt 16 so as to hold the intermediate transfer belt 16 with the driven roller 18 arranged inside the loop. A portion of the surface of the intermediate transfer belt 16 between the secondary transfer roller 20 and the driven roller 18 is referred to as a secondary transfer nip. A secondary transfer bias is applied to the secondary transfer roller 20 by a transfer-bias power supply (not shown). By the application of the secondary transfer bias, a secondary-transfer electric field is formed between the secondary transfer roller 20 and the driven roller 18 ground-connected to the secondary transfer roller 20.

The secondary transfer roller 20 is formed to have a diameter of 19 mm and a width of 222 mm in such a manner that a metal bar of diameter 6 mm as a core, which is made by, for example, steel use stainless (SUS), is covered with an elastic medium such as urethane that is adjusted to have a resistance in a range of $10^6\Omega$ to $10^{10}\Omega$ by a conductive material. Specifically, an ion-conductive roller (made by urethane in which carbon is dispersed, nitrile-butadiene rubber (NBR), and hydrin), an electronically conductive roller (made by ethylene propylene dieneterpolymers (EPDM)), or the like can be used as the secondary transfer roller 20. In the present embodiment, a urethane roller having a diameter of 20 mm and an Asker C hardness of 35 degrees to 50 degrees is used as the secondary transfer roller 20. When a resistance of the secondary transfer roller 20 exceeds the above range, it is difficult to flow a sufficient current into the secondary transfer roller 20. Therefore, to obtain a sufficient transferability, a higher voltage needs to be applied to the secondary transfer roller 20, and thus a cost of power supply is increased. In addition, by the application of the higher voltage, an electric discharge occurs in a space around the secondary transfer nip, so that a white spot is generated on a halftone image due to the electric discharge. Such a defect occurs prominently in environmental conditions of a low temperature and a low humidity (for example, in environmental conditions of a temperature of 10° C. and a relative humidity of 15%). On the other hand, when a resistance of the secondary transfer roller 20 drops below the above range, it is not possible to achieve a transferability for an image including a multicolor image portion (such as a superimposed three-color toner image portion) and a monochrome image portion. This is because the resistance of the secondary transfer roller 20 is low, so that a sufficient current for the transfer of the monochrome image portion requiring a relatively low voltage can be flown into the secondary transfer roller 20. However, the transfer of the multicolor image portion requires a higher voltage than the voltage appropriate to the monochrome image portion. If a voltage is set to be appropriate to the multicolor image portion, an excess current for the transfer of the monochrome image portion is flown, and thereby causing a decrease of the transfer efficiency for the monochrome image portion.

Incidentally, a resistance of the secondary transfer roller 20 is measured under conditions that the secondary transfer roller 20 is installed on a conductive metal plate, and a load of 4.9 Newtons (N) is applied to both ends of the cored bar. The resistance of the secondary transfer roller 20 is obtained based on a current flown thereinto when a voltage of 1 kV is applied to a portion between the cored bar and the metal plate.

A stack of recording sheets P is contained in a sheet cassette 30 provided below the transfer unit 15 in the vertical direction. The sheet cassette 30 is slidably attached to an enclosure of the printer, and can be removed from the printer. The sheet cassette 30 includes a sheet feed roller 30*a*, and the sheet feed roller 30*a* is provided to have contact with the top of the stack of the recording sheets P. The sheet feed roller 30*a* is driven to rotate counterclockwise in FIG. 1 at a predetermined timing, and thereby feeding a top recording sheet P of the stack to a sheet feed path 31.

A pair of registration rollers 32 is provided near a terminal end of the sheet feed path 31. The registration rollers 32 are driven to rotate. Once the registration rollers 32 hold a leading end of the recording sheet P fed from the sheet cassette 30 between them, the rotation of the registration rollers 32 is stopped. The registration rollers 32 are driven to rotate again so that the recording sheet P is conveyed to the secondary transfer nip in accordance with the rotation of the registration rollers 32 to be in synchronization with a timing that the four-color toner image on the intermediate transfer belt 16 comes to the secondary transfer nip in accordance with the movement of the intermediate transfer belt 16.

At the secondary transfer nip, the four-color toner image on the intermediate transfer belt 16 is secondary-transferred onto the recording sheet P by the action of the secondary transfer electric field and nip pressure. By the secondary transfer of the four-color toner image onto the recording sheet P, the four-color toner image and white color of the recording sheet P combine to form a full-color toner image. When the recording sheet P on which the full-color toner image is formed passes through the secondary transfer nip, the recording sheet P is self-stripped from the secondary transfer roller 20 and the intermediate transfer belt 16 by the use of the curvature of the driven roller 18 and the secondary transfer roller 20. Then, the recording sheet P is conveyed to a fixing unit 34 to be described later via a post-transfer sheet path 33.

After the recording sheet P passes through the secondary transfer nip, transfer residual toner, which has not been transferred onto the recording sheet P, remains on the intermediate transfer belt 16. The transfer residual toner is cleaned from the surface of the intermediate transfer belt 16 by being scraped off by an intermediate-transfer-belt cleaning blade 21*a* included in the belt cleaning unit 21. The cleaning backup roller 22 arranged inside the loop of the intermediate transfer belt 16 backs up the cleaning of the intermediate transfer belt 16 by the intermediate-transfer-belt cleaning blade 21*a* from inside the loop.

The intermediate-transfer-belt cleaning blade 21*a* is made of polyurethane rubber having a thickness of 1.5 mm to 3 mm and a rubber hardness of 65 degrees to 80 degrees. The intermediate-transfer-belt cleaning blade 21*a* is arranged to be in contact with the intermediate transfer belt 16 at an angle of counter with respect to the moving direction of the intermediate transfer belt 16. The scraped transfer residual toner is conveyed into an intermediate-transfer-belt waste toner container (not shown) through a waste toner path (not shown), and contained in the intermediate-transfer-belt waste toner container. At the time of assembling the printer, an embrocation, such as a lubricant, toner, or zinc stearate, is applied to at least any one of a portion of the intermediate transfer belt 16 corresponding to a cleaning nip and an edge portion of the intermediate-transfer-belt cleaning blade 21*a*. Therefore, it is possible to prevent the intermediate-transfer-belt cleaning blade 21*a* from being ridden up at the cleaning nip portion. In addition, a dam layer is formed by the embrocation at the cleaning nip portion, so that the cleaning performance can be improved.

Furthermore, although it is not shown in the diagram, a toner mark (TM) sensor is provided at a position opposed to the intermediate transfer belt 16. The TM sensor is a specular reflective optical sensor or a diffuse reflective optical sensor, and measures a density and a position of each of the Y, M, C, and K toner images on the intermediate transfer belt 16 to adjust the image density or color matching. The TM sensor can be either a specular reflective optical sensor or a diffuse reflective optical sensor.

The fixing unit 34 includes a fixing roller 34*a* and a pressure roller 34*b*. The fixing roller 34*a* includes a heat-generating source (not shown) such as a halogen lamp. The pressure roller 34*b* rotates by pressing the fixing roller 34*a* at a predetermined pressure. A fixing nip is formed between the fixing roller 34*a* and the pressure roller 34*b*. When the recording sheet P on which the full-color toner image is formed is conveyed into the fixing unit 34, the recording sheet P is held in the fixing nip so that the front side of the recording sheet P, i.e., the side where the full-color toner image is formed is in close contact with the fixing roller 34*a*. When the recording sheet P passes through the fixing nip, by the application of heat and pressure by the fixing roller 34*a* and the pressure roller 34*b*, toners of the full-color toner image are softened, and the full-color toner image is fixed on the recording sheet P. In this manner, the printer forms a full-color image on the recording sheet P.

After that, the recording sheet P is conveyed from the fixing unit 34 to a bifurcation into a sheet discharge path 36 and a pre-reversal sheet path 41 via a post-fixation sheet path 65. On the side of the post-fixation sheet path 65, a switching claw 42 is provided. The switching claw 42 is driven to turn around a rotating shaft 42*a*. A terminal end of the post-fixation sheet path 65 is closed or opened by the turning of the switching claw 42. At a timing that the recording sheet P is conveyed from the fixing unit 34, as shown in FIG. 1, the switching claw 42 stops at a position indicated by a solid line, and the terminal end of the post-fixation sheet path 65 is opened. Therefore, the recording sheet P enters in the sheet discharge path 36 from the post-fixation sheet path 65, and held between a pair of sheet discharge rollers 67.

When a one-side printing mode is set by an operational input to, for example, an operating unit (not shown) including a numeric keypad or the like or a control signal transmitted from a personal computer (not shown) or the like, the recording sheet P held between the sheet discharge rollers 67 is discharged from the printer. Then, the recording sheet P is stacked on a stacking unit, i.e., a top surface of an upper cover 50 of the enclosure.

On the other hand, when a duplex printing mode is set, the recording sheet P is conveyed on the sheet discharge path 36 until a trailing end of the recording sheet P passes through the post-fixation sheet path 65 while the leading-end side of the recording sheet P is held between the sheet discharge rollers 67. When the trailing end of the recording sheet P passes through the post-fixation sheet path 65, the switching claw 42 turns to a position indicated by a dotted line shown in FIG. 1, and the terminal end of the post-fixation sheet path 65 is closed. At this time, the sheet discharge path 36 is linked up to the pre-reversal sheet path 41 by the switching claw 42. Nearly simultaneously, the sheet discharge rollers 67 start rotating in a reverse direction, and the recording sheet P is conveyed backward, i.e., is reversely conveyed with the trailing end in the lead into the pre-reversal sheet path 41.

FIG. 1 depicts the printer viewed from the front side thereof. The front side of the printer in FIG. 1 in a direction perpendicular to a plane of the diagram is a front face of the printer, and the back side is a rear face. Furthermore, the right side of the printer in FIG. 1 is a right-side face of the printer, and the left side is a left-side face. An openable reversing unit 40 is provided on the extreme right of the printer. The reversing unit 40 is capable of turning around a rotating shaft 40*a*, and is opened/closed with respect to a main body of the enclosure by turning around the rotating shaft 40*a*. When the sheet discharge rollers 67 rotate in the reverse direction, the recording sheet P enters in the pre-reversal sheet path 41 in the reversing unit 40 with the trailing end in the lead, and is conveyed downward in the vertical direction. After passing through a pair of reverse conveying rollers 43, the recording sheet P enters in a sheet reversing path 44 curved in a semicircle. As the recording sheet P is conveyed on the semicircular sheet reversing path 44, the recording sheet P is reversed, i.e., is turned over, and conveyed upward in the vertical direction while the reverse side of the recording sheet P is faced up. After that, the recording sheet P again enters in the secondary transfer nip via the sheet feed path 31. By passing through the secondary transfer nip, a four-color toner image is secondary-transferred onto the reverse side of the recording sheet P. The recording sheet P is conveyed through the post-transfer sheet path 33, the fixing unit 34, the post-fixation sheet path 65, the sheet discharge path 36, and the sheet discharge rollers 67 sequentially, and discharged from the printer. In this manner, a full-color image is formed on the both sides of the recording sheet P.

Furthermore, in the present embodiment, a processing speed of the fixing unit 34 is adjusted depending on a type of the recording sheet P. Specifically, when a sheet having a basis weight of 100 g/m$^2$ or more is used as the recording sheet P, the processing speed is reduced by half as compared with a normal processing speed so that it takes the recording sheet P twice as long to pass through the fixing nip formed between formed between the fixing roller 34*a* and the pressure roller 34*b* as compared with a case of the normal processing speed. Therefore, it is possible to ensure the fixation stability of the toner image.

The reversing unit 40 includes an outer cover 45 and an oscillating body 46. Specifically, the outer cover 45 is rotatably supported by the rotating shaft 40*a* provided on the enclosure of the printer main body. When the outer cover 45 rotates around the rotating shaft 40*a*, the outer cover 45 is opened/closed with respect to the enclosure with holding the oscillating body 46 inside thereof. When the outer cover 45 is opened together with the oscillating body 46 as indicated by a dotted line shown in FIG. 1, the sheet feed path 31, the secondary transfer nip, the post-transfer sheet path 33, the fixing nip, the post-fixation sheet path 65, and the sheet discharge path 36, which are formed between the reversing unit 40 and the side of the printer main body, are longitudinally split in two, and exposed to the outside. Therefore, if a paper jam occurs in any of the sheet feed path 31, the secondary transfer nip, the post-transfer sheet path 33, the fixing nip, the post-fixation sheet path 65, and the sheet discharge path 36, the jammed recording sheet P can be easily removed therefrom.

The oscillating body 46 is rotatably supported by the outer cover 45 so that the oscillating body 46 can turn around an oscillating shaft (not shown) provided on the outer cover 45 when the outer cover 45 is opened. When the oscillating body 46 turns, and is opened with respect to the outer cover 45, the pre-reversal sheet path 41 and the sheet reversing path 44 are longitudinally split in two, and exposed to the outside. Therefore, if a paper jam occurs in any of the pre-reversal sheet path 41 and the sheet reversing path 44, the jammed recording sheet P can be easily removed therefrom.

The upper cover 50 of the enclosure of the printer is rotatably supported so as to rotate around a rotating shaft 51 as indicated by a two-headed arrow shown in FIG. 1. When the upper cover 50 rotates counterclockwise in FIG. 1 with holding the optical writing unit 70, the upper cover 50 is opened with respect to the enclosure, and an upper opening of the enclosure is widely exposed to the outside. By the exposure of the upper opening of the enclosure, the process units 1Y, 1M, 1C, and 1K are exposed to the outside.

Figure 10:
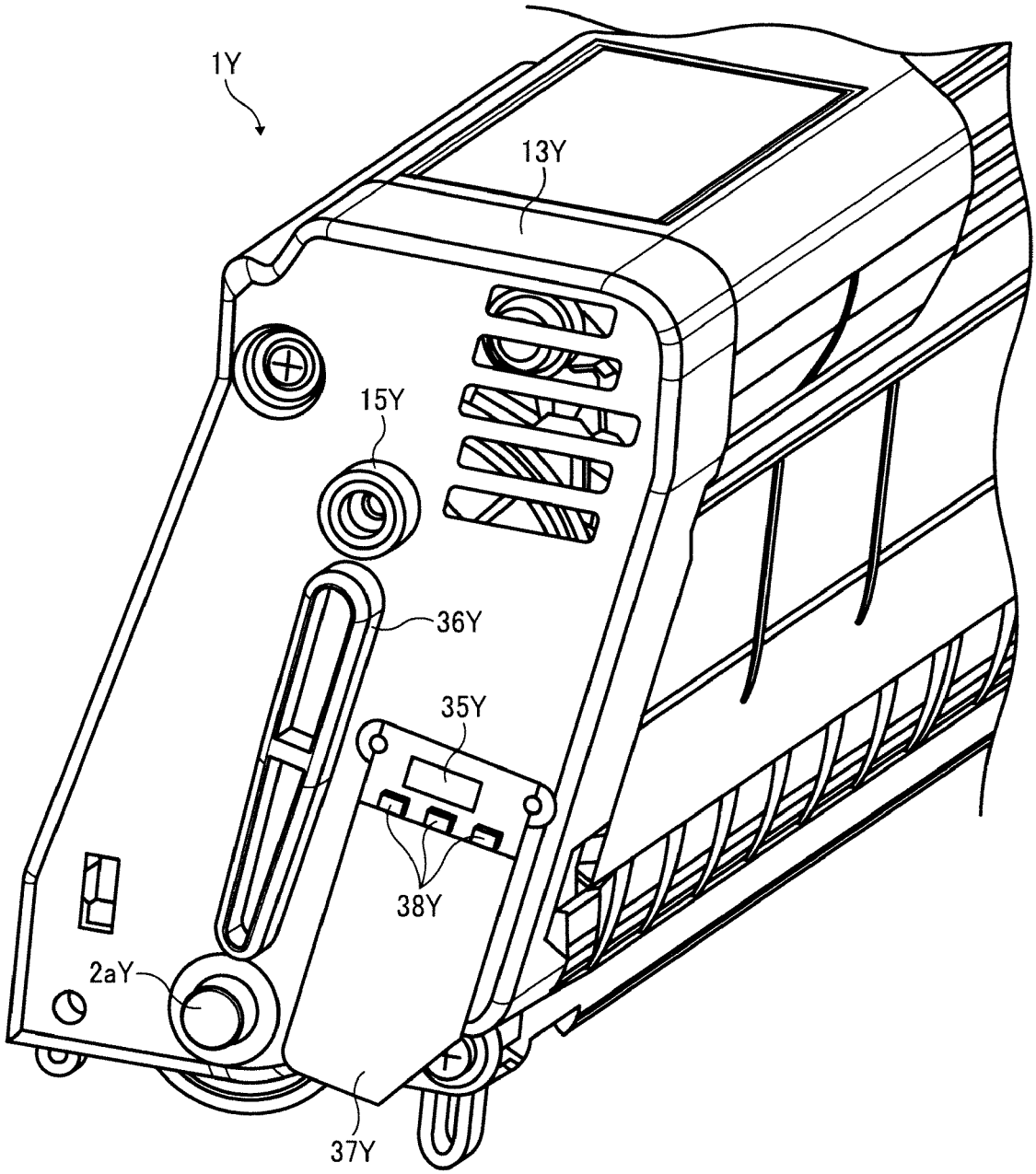
FIG. 10 is a side perspective view of the yellow-color process unit.

As shown in FIG. 10, on a surface of a case 13Y on the front side of a casing of the process unit 1Y (hereinafter, "the front-side case 13Y"), a photosensitive-drum shaft 2*a*Y as a main-positioning projection, a sub-positioning projection 15Y, and a slide guide projection 36Y are provided so as to project from the surface of the front-side case 13Y. Furthermore, the ID chip 35Y as an electronic-information storage unit, a plurality of communication electrodes 38Y, a protective sheet 37Y, and the like are provided on the surface of the front-side case 13Y.

Figure 3:
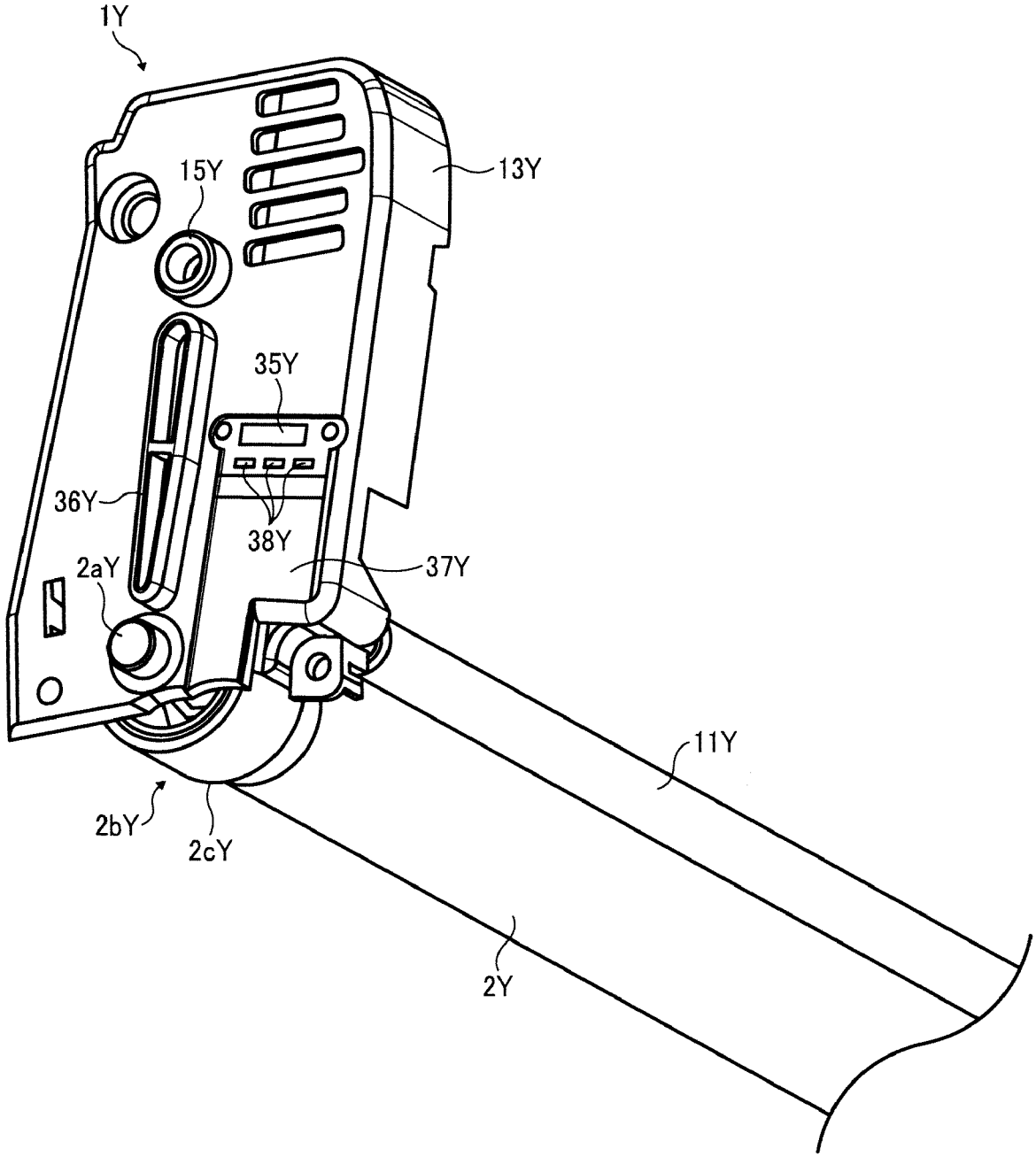
FIG. 3 is a partial perspective view of a yellow-color process unit included in the printer viewed from a bottom side thereof.

FIG. 3 is a partial perspective view of the front side of the process unit 1Y viewed from the bottom thereof. As shown in FIG. 3, the photosensitive-drum shaft 2*a*Y penetrates through the front-side case 13Y, and an end of the photosensitive-drum shaft 2*a*Y projects outward from the surface of the front-side case 13Y. The photosensitive drum 2Y is rotatably supported by the photosensitive-drum shaft 2*a*Y. A photosensitive-drum gear 2*b*Y is formed on an outer circumferential surface of a front-side flange 2*c*Y, which is press-fitted into the front-side end of the photosensitive drum 2Y.

The sub-positioning projection 15Y projects from the upper side of the front-side case 13Y and also in the center of the front-side case 13Y in a thickness direction. The slide guide projection 36Y is formed into a rail, and extends between a portion near the end of the photosensitive-drum shaft 2*a*Y and a portion near the sub-positioning projection 15Y in a height direction of the process unit 1Y.

In FIG. 3, out of both end portions of the process unit 1Y in a longer direction (i.e., out of a front-side end portion and a back-side end portion of the process unit 1Y), only the front-side end portion of the process unit 1Y is illustrated. Although it is not illustrated in FIG. 3, on a surface of a back-side case, in the same manner as the front-side case 13Y, a sub-positioning projection and a slide guide projection are provided, and the other end of the photosensitive-drum shaft 2*a*Y penetrates through the back-side case so as to project outward from the surface of the back-side case.

The ID chip 35Y is mounted on the surface of the front-side case 13Y. Information such as a running distance of the photosensitive drum 2Y, a consumed amount of toner, a remaining amount of toner, an amount of waste toner, an identification (ID) number of the process unit 1Y, a date of manufacture, color information, and the like is stored in the ID chip 35Y. The communication electrodes 38Y are connected to respective input-output terminals (not shown) of the ID chip 35Y.

Figure 11:
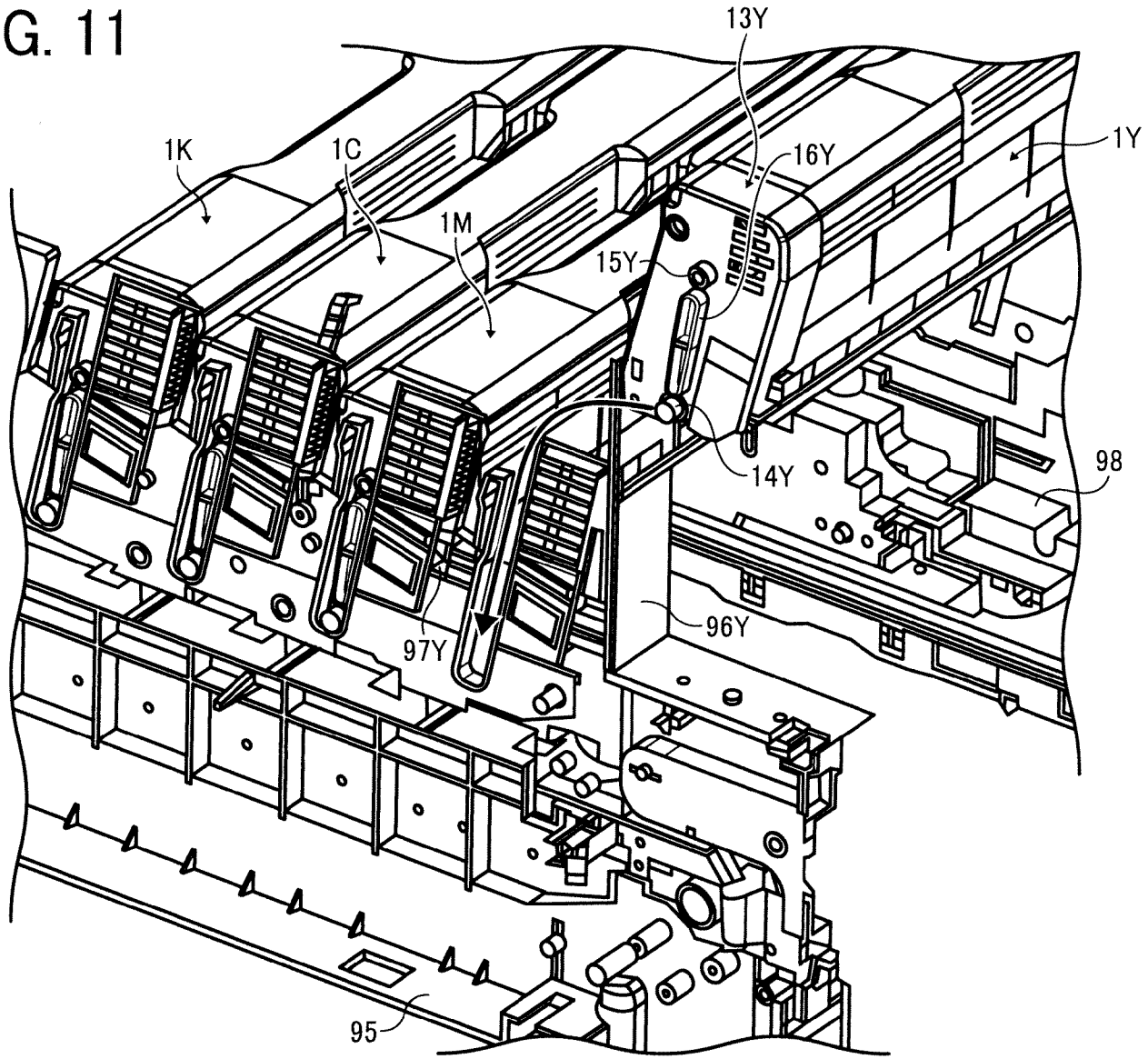
FIG. 11 is a perspective view of four process units in an enclosure of the printer.
Figure 12:
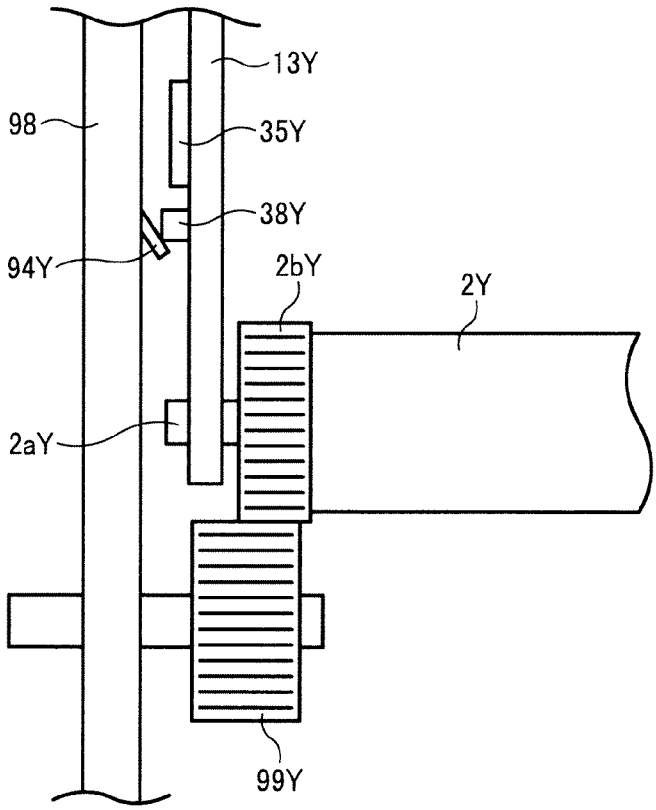
FIG. 12 is an enlarged side view of the yellow-color process unit in the enclosure.

As shown in FIG. 11, a front side plate 95 and the back side plate 98 are provided in the enclosure of the printer main body on the front and back sides of the printer respectively (in the longer direction of the process units 1Y, 1M, 1C, and 1K) so that the front side plate 95 and the back side plate 98 are faced to each other with keeping a predetermined distance between them. The process units 1Y, 1M, 1C, and 1K are, as shown in FIG. 11, set up as if the process units 1Y, 1M, 1C, and 1K spanned between the front side plate 95 and the back side plate 98 in a posture that their long side is parallel to a facing direction of the front side plate 95 and the back side plate 98.

Figure 4:
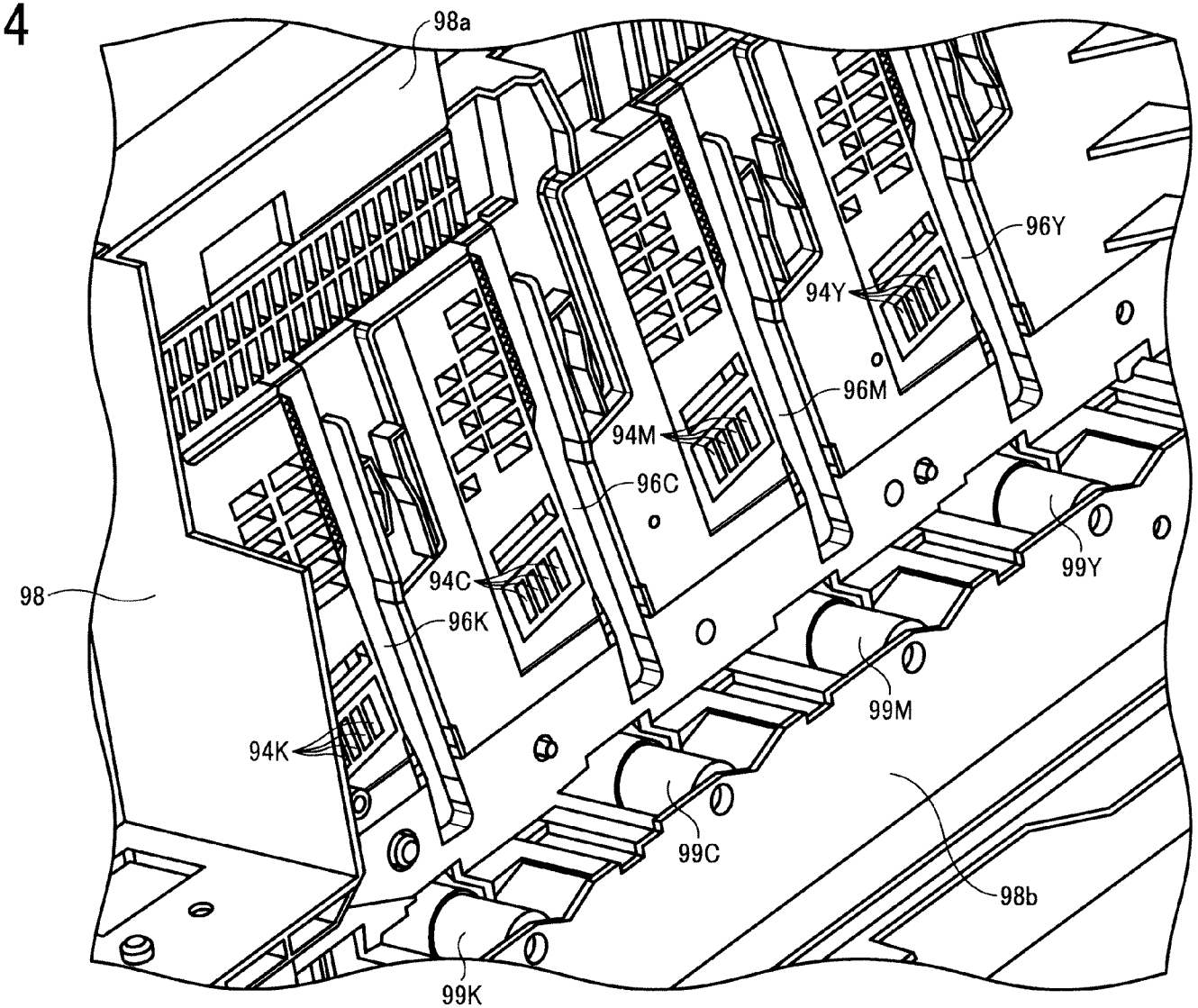
FIG. 4 is an enlarged view of a main part on a back side plate of the printer.

FIG. 4 is an enlarged view of a main part on the back side plate 98. As shown in FIG. 4, on an opposed surface 98*a* of the back side plate 98 on the side opposed to the front side plate 95, slits 96Y, 96M, 96C, and 96K extending in a direction slightly-tilted to the vertical direction are provided to notch an upper end of the back side plate 98. The slits 96Y, 96M, 96C, and 96K serve to guide the process units 1Y, 1M, 1C, and 1K to set positions, respectively. Furthermore, on the opposed surface 98*a* of the back side plate 98, a plurality of plate-like contact electrodes 94Y, 94M, 94C, and 94K are provided so that the contact electrodes 94Y, 94M, 94C, and 94K project downward from the opposed surface 98*a*. When the process unit 1 is set up in the printer main body, the contact electrodes 94 are in contact with the communication electrodes 38 respectively.

Moreover, on a surface opposite to an opposed surface 98*b* of the back side plate 98, which is opposed to the transfer unit and located in front of the opposed surface 98*a*, drive gears 99Y, 99M, 99C, and 99K are provided. The drive gears 99Y, 99M, 99C, and 99K are, as shown in FIG. 4, not located right under lower ends of the slits 96Y, 96M, 96C, and 96K in the vertical direction but they are provided at a location that is shifted on the left of the slits 96Y, 96M, 96C, and 96K in FIG. 4, respectively. When the process units 1Y, 1M, 1C, and 1K are set up in the printer main body, the drive gears 99Y, 99M, 99C, and 99K engage with the photosensitive-drum gears 2*b*Y, 2*b*M, 2*b*C, and 2*b*K, respectively. Furthermore, on the front side plate 95, similar slits are provided in the same manner as the slits 96Y, 96M, 96C, and 96K.

As shown in FIG. 11, when mounting the process unit 1Y in the printer main body, a user holds the process unit 1Y in a posture that the long side of the process unit 1Y is parallel to the facing direction of the front side plate 95 and the back side plate 98, and drops in the process unit 1Y from the upper side of the printer. Then, the user puts the end of the photosensitive-drum shaft 2*a*Y projecting from the lower side of the front-side case 13Y into an inlet of the slit 96Y provided on the front side plate 95. At the same time, the user puts the other end of the photosensitive-drum shaft 2*a*Y into an inlet of the corresponding slit provided on the back side plate 98.

After that, the user slides the both ends of the photosensitive-drum shaft 2*a*Y downward in a direction of mounting the process unit 1Y in the slit 96Y and the corresponding slit while further dropping in the process unit 1Y in the same posture. Shortly afterward, the slide guide projection 36Y provided on the front-side case 13Y enters in the inlet of the slit 96Y, and slides in the slit 96Y. Nearly simultaneously, the slide guide projection provided on the back-side case enters in the inlet of the slit provided on the back side plate 98, and slides in the slit.

When the process unit 1Y is further dropped below, a trailing end of the slide guide projection 36Y passes through the inlet of the slit 96Y. And, the sub-positioning projection 15Y provided on the front-side case 13Y enters in the inlet of the slit 96Y, and slides in the slit 96Y. Furthermore, nearly simultaneously, the sub-positioning projection provided on the back-side case enters in an inlet of the slit provided on the back side plate 98, and slides in the slit.

Then, when the process unit 1Y is further dropped below, after a while, the end of the photosensitive-drum shaft 2*a*Y projecting from the lower side of the front-side case 13Y is bumped into a lower end of an inner wall of the slit 96Y. Furthermore, nearly simultaneously, the other end of the photosensitive-drum shaft 2*a*Y projecting from the lower side of the back-side case is bumped into a lower end of an inner wall of the slit provided on the back side plate 98. The ends of the photosensitive-drum shaft 2*a*Y are bumped into the lower ends of the slits, and thus a position of the process unit 1Y in the enclosure of the printer in a longer direction of the slit 96Y (and the other slit) (i.e., in a direction of attaching/detaching the process unit 1Y) can be determined. At the same time, a position of the sub-positioning projection 15Y in the slit 96Y is determined at a different position from the photosensitive-drum shaft 2*a*Y by contact with the inner wall of the slit 96Y. In this manner, the position and the posture of the entire process unit 1Y are corrected.

Incidentally, if the slide guide projection 36Y is not provided, in the course of further dropping in the process unit 1Y downward after the ends of the photosensitive-drum shaft 2*a*Y are put into the slit 96Y and the other-side slit, the sub-positioning projection 15Y may be bumped into an upper end of the back side plate 98 depending on the posture (an angle) of the process unit 1Y. However, when the slide guide projection 36Y is provided, the slide guide projection 36Y is fitted into the slit 96Y, so that the posture of the process unit 1Y when being dropped in can be controlled. Therefore, it is possible to guide the sub-positioning projection 15Y to the slit 96Y smoothly, and thus an operability of setting up the process unit 1Y can be improved.

As shown in FIG. 11, when the process unit 1Y is set up at a position so that the ends of the photosensitive-drum shaft 2*a*Y are bumped into the lower ends of the inner walls of the slits (see the slit 96Y in FIG. 11) (i.e., at the normal set position), the contact electrodes 94Y are in contact with the communication electrodes 38Y, respectively. In the printer, a control unit (not shown) provided in the enclosure of the printer and the ID chip 35Y communicate information with each other via the communication electrodes 38Y and the contact electrodes 94Y that are in contact with each other. The control unit (including a central processing unit (CPU), a random access memory (RAM), a read-only memory (ROM), and the like) controls activation of each of the process units 1Y, 1M, 1C, and 1K and the transfer unit 15. For example, the control unit communicates with the ID chip 35Y, and acquires information stored in the ID chip 35Y, such as an ID number of the process unit 1Y or a date of manufacture. The acquired information is used, for example, to determine an expected life of the process unit 1Y or to determine whether the process unit 1Y is replaced or just attached/detached. Furthermore, while the photosensitive drum 2Y is driven to rotate, for example, the control unit writes an amount of toner on the ID chip 35Y or reads out an amount of toner from the ID chip 35Y, and displays a remaining amount of toner on a screen of the personal computer. Incidentally, information stored in the ID chip 35Y, such as a running distance of the photosensitive drum 2Y, a consumed amount of toner, and an amount of waste toner, is used to check how a user uses the printer (for example, how often a black-and-white image is printed out) after replacement of the process unit 1Y.

Out of a whole planar area of the front-side case 13Y of the process unit 1Y, an area of a portion of the front-side case 13Y that has sliding contact with the contact electrodes 94Y in the course of mounting the process unit 1Y in the printer main body (in this example, an area below the communication electrodes 38Y) is covered with the protective sheet 37Y. The protective sheet 37 is made of polyethylene terephthalate (PET) having a smaller friction coefficient than that of the naked surface of the front-side case 13Y. In other words, the area of the portion of the front-side case 13Y that has sliding contact with the contact electrodes 94Y of the printer main body (the back side plate 98) in the course of mounting the process unit 1Y in the printer main body is processed to lower a friction. Therefore, it is possible to prevent the front-side case 13Y from getting scratched because no naked surface of the front-side case 13Y has direct sliding contact with the contact electrodes 94Y of the printer main body.

Each of the drive gears 99 (99Y, 99M, 99C, and 99K) is, as shown in FIG. 4, not provided right under the lower end of the slit 96 (96Y, 96M, 96C, and 96K) in the vertical direction but they are provided at locations that are shifted on the left of the slit 96 in the diagram. Therefore, when the drive gear 99 drives the photosensitive drum 2 (2Y, 2M, 2C, and 2K) to rotate in the forward direction, surface movement of a portion of the drive gear 99 that is engaged with the photosensitive-drum gear 2*b* is directed downward. Thus, when the drive gear 99 drives the photosensitive drum 2 to rotate in the forward direction, a downward force is exerted on the photosensitive-drum gear 2*b* by the drive gear 99. Consequently, when the photosensitive drum 2 rotates in the forward direction, it is possible to set up the process unit 1 at the normal set position reliably.

Incidentally, the drive gear 99 and the photosensitive-drum gear 2*b* are configured as a pair of helical gears so as to reduce a noise occurring in the gear engagement and prevent an image defect such as a banding. Teeth of the helical gears are helically twisted in a direction so that a thrust force in a direction of increasing a face width of the teeth of the photosensitive-drum gear 2*b* and the drive gear 99 is exerted on each of the gears when the photosensitive drum 2 rotates in the forward direction.

Figure 5:
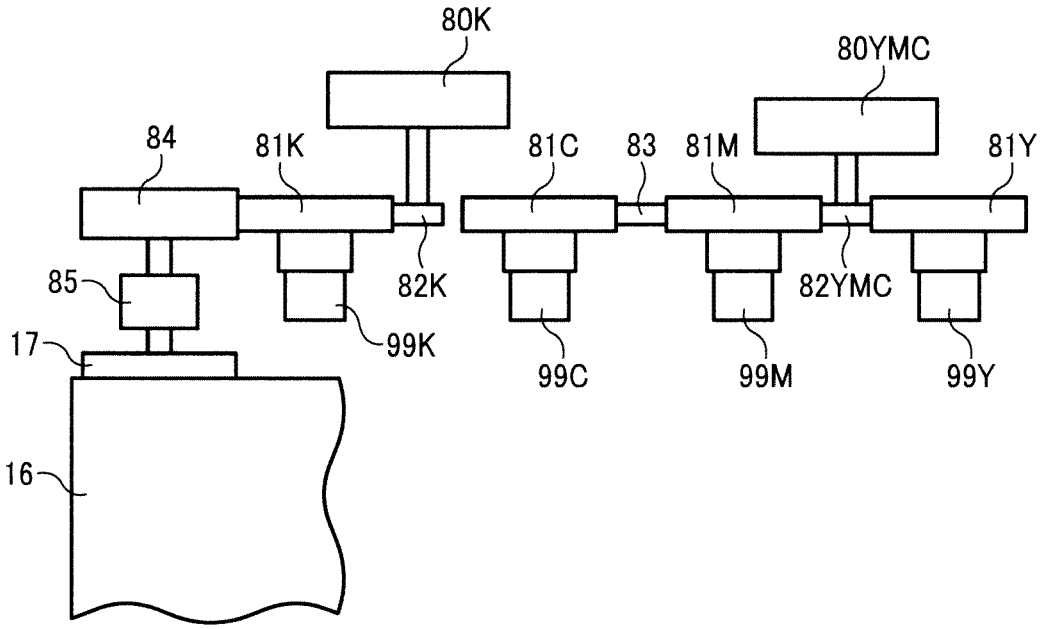
FIG. 5 is a schematic top view of a driving-force transmission mechanism of the printer.

FIG. 5 is a schematic top view of a driving-force transmission mechanism that drives the photosensitive drums 2 and the intermediate transfer belt 16 to rotate.

As shown in FIG. 5, the driving-force transmission mechanism is composed of a photosensitive-drum drive motor 80YMC and a photosensitive-drum drive motor 80K. The photosensitive-drum drive motor 80YMC is a drive source for driving the photosensitive drums 2Y, 2M, and 2C to rotate. The photosensitive-drum drive motor 80K is a drive source for driving the photosensitive drum 2K and the intermediate transfer belt 16 to rotate. The photosensitive-drum drive motor 80YMC and the photosensitive-drum drive motor 80K are fixed to a main body frame (not shown). The photosensitive-drum drive motor 80YMC and the photosensitive-drum drive motor 80K are configured to be capable of rotating in any of the forward and reverse directions.

A drive gear 82YMC is fixed to a drive shaft of the photosensitive-drum drive motor 80YMC, and engaged with an output gear 81Y and an output gear 81M. The output gear 81M is further engaged with an idler gear 83. The idler gear 83 is further engaged with an output gear 81C.

A drive gear 82K is fixed to a drive shaft of the photosensitive-drum drive motor 80K, and engaged with an output gear 81K. The output gear 81K is further engaged with a transfer output gear 84. The drive gears 99Y, 99M, 99C, and 99K are provided in the shaft centers of the output gears 81Y, 81M, 81C, and 81K, respectively.

When the printer forms a full-color image, the photosensitive-drum drive motor 80YMC is driven thereby driving the photosensitive drums 2Y, 2M, and 2C to rotate. And, the photosensitive-drum drive motor 80K is driven thereby driving the photosensitive drum 2K to rotate and also driving the drive roller 17 to rotate via the output gear 81K, the transfer output gear 84, and a coupling 85, and thereby driving the intermediate transfer belt 16 to rotate. In this manner, when the printer forms a black-and-white image, only the photosensitive drum 2K is driven to rotate, so that it is possible to minimize wear and tear on the other photosensitive drums 2Y, 2M, and 2C and the photosensitive-drum drive motor 80YMC and to save energy. Incidentally, when the printer forms a black-and-white image, only the photosensitive drum 2K is driven to rotate as described above. At this time, the transfer unit 15 changes its position so as to cause the intermediate transfer belt 16 to be in contact with only the photosensitive drum 2K. Furthermore, instead of the single photosensitive-drum drive motor 80YMC, three photosensitive-drum drive motors for driving the photosensitive drums 2Y, 2M, and 2C to rotate can be provided.

Furthermore, in the printer, the photosensitive-drum drive motor 80K drives not only the photosensitive drum 2K but also the intermediate transfer belt 16 to rotate. Therefore, as compared with the one including a drive motor for driving the photosensitive drum 2K and a drive motor for driving the intermediate transfer belt 16 separately, a production cost is reduced, and footprint downsizing is achieved.

Moreover, in the printer, the control unit is configured to execute a reverse sequence of causing the photosensitive drum 2 and the intermediate transfer belt 16 to rotate in the reverse direction upon completion of a print job after the intermediate transfer belt 16 runs a predetermined distance. By the execution of the reverse sequence, foreign substances can be removed from the cleaning blade 3*a* of the drum cleaning unit 3K and the intermediate-transfer-belt cleaning blade 21*a* of the belt cleaning unit 21, and thus the cleaning blade 3*a* and the intermediate-transfer-belt cleaning blade 21*a* can be maintained in good condition over time. Alternatively, the control unit can be configured to execute the reverse sequence upon completion of a print job after the photosensitive drum 2 runs a predetermined distance or each time a print job is completed. Incidentally, when the photosensitive-drum drive motor 80K is driven to rotate in the reverse direction thereby driving the photosensitive drum 2K to rotate in the reverse direction, the intermediate transfer belt 16 rotates in the reverse direction in synchronization with the reverse rotation of the photosensitive drum 2K. Therefore, it is possible to remove foreign substances from not only the cleaning blade 3*a*K but also the intermediate-transfer-belt cleaning blade 21*a* at the same time. Furthermore, the intermediate transfer belt 16 rotates in the reverse direction in synchronization with the reverse rotation of the photosensitive drum 2, so that it is possible to prevent the intermediate transfer belt 16 and the photosensitive drum 2 from being damaged.

Figure 13:
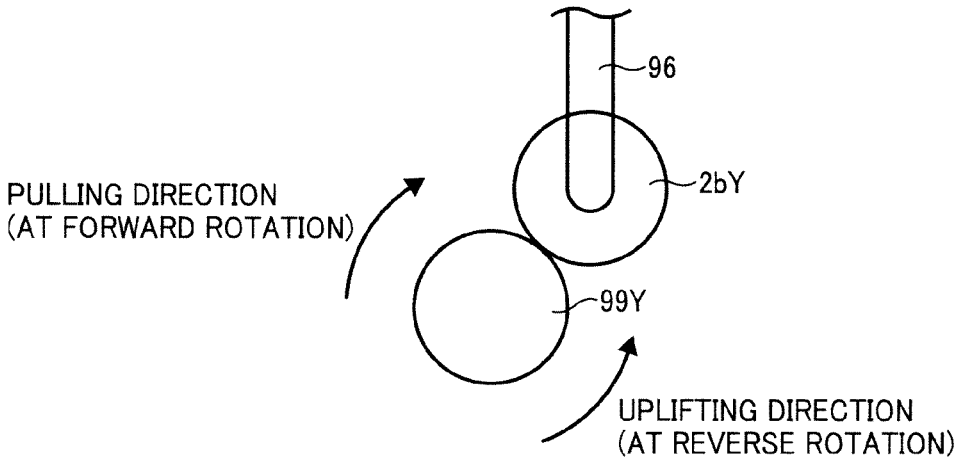
FIG. 13 is a schematic diagram of a drive gear and a photosensitive-drum gear.

However, during the execution of the reverse sequence, as shown in FIG. 13, a vertically upward force is exerted on the photosensitive-drum gear 2*b*Y by the drive gear 99Y. By the action of the vertically upward force, the process unit 1 may be uplifted, or a tooth jumping may occur thereby causing the process unit 1 to be uplifted. When the process unit 1 is uplifted, the contact between the communication electrodes 38 and the contact electrodes 94 becomes loose, which may result in a contact failure. In such a state, if the control unit communicates with the ID chip 35Y, an access error may occur, or wrong information may be written on the ID chip 35Y. Furthermore, while the drive gear 99 rotates in the reverse direction, a thrust force in a direction that the drive gear 99 and the photosensitive-drum gear 2*b* draw apart from each other is generated in the drive gear 99 and the photosensitive-drum gear 2*b*. By the action of the thrust force, the contact between the communication electrodes 38 and the contact electrodes 94 becomes loose, which may result in a contact failure. Therefore, in the printer, during execution of the reverse sequence, the control unit is stopped from communicating with the ID chip 35Y. Such a communication control is concretely explained below.

Figure 6:
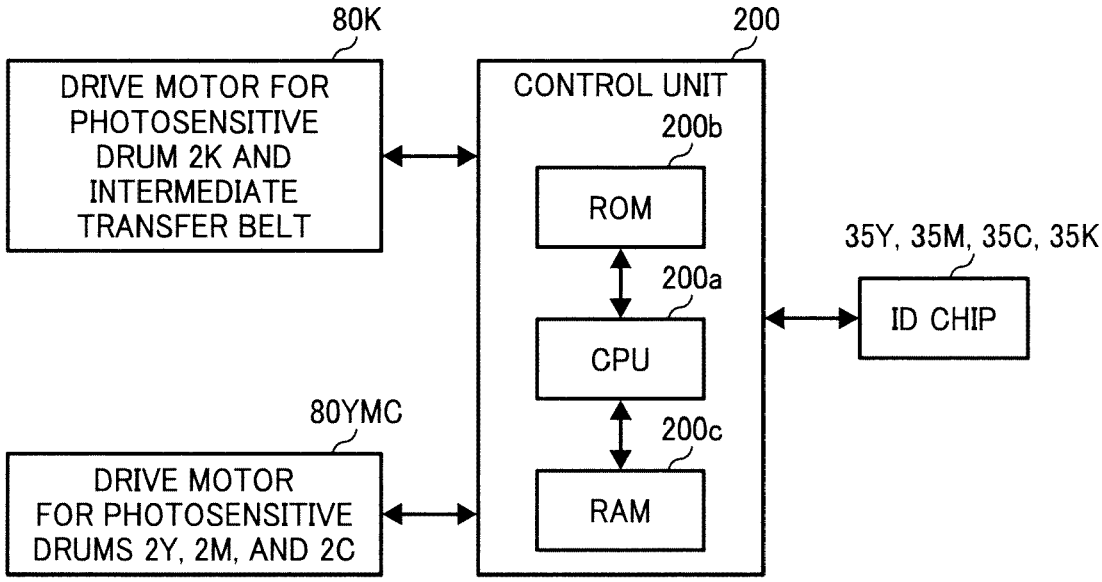
FIG. 6 is a block diagram of a portion of an electrical circuit of the printer.

FIG. 6 is a block diagram of a portion of an electrical circuit of the printer.

Although a control unit 200 controls the entire printer actually, only elements required for the explanation of the communication control are illustrated in FIG. 6. The control unit 200 includes a CPU 200*a*, a ROM 200*b*, and a RAM 200*c*. The CPU 200*a* performs a calculation or controls activation of each of the units. In the ROM 200*b*, fixed data such as a computer program is stored in advance. The RAM 200*c* serves as a working area or the like. Data stored in the working area can be rewritten. Each of the ROM 200*b* and the RAM 200*c* is connected to the CPU 200*a* via a bus line. A computer program for causing the printer to execute the reverse sequence upon completion of a print job after the intermediate transfer belt 16 runs the predetermined distance, a communication program for causing the control unit 200 to communicate with each of the ID chips 35Y, 35M, 35C, and 35K at a predetermined timing, and the like are stored in the ROM 200*b* in advance. In other words, the control unit 200 also serves as a communicating unit.

The communication between the control unit 200 and each of the ID chips 35Y, 35M, 35C, and 35K is preferably made by an inter integrated circuit (I2C) as a general communication protocol. By the I2C communication, as will be described in detail in a fourth example, the control unit 200 can detect a communication error in communication with the ID chip 35 or whether wrong information is written/read out.

As a concrete example of the I2C communication, a case where the control unit 200 (as a master) writes information on the ID chip 35 (as a slave) is described below. Upon receiving data from the control unit 200, the ID chip 35 transmits the received data with the addition of an ACK bit as an acknowledgment signal to the foot of the data to the control unit 200. Upon receiving the data from the ID chip 35, the control unit 200 compares the received data with the transmitted data. As a result of the comparison, if the received data is not same as the transmitted data, the control unit 200 determines that wrong information is written, i.e., a communication failure occurs. Furthermore, when the control unit 200 does not receive the ACK bit even after the elapse of a predetermined time, the control unit 200 determines that a communication error occurs, i.e., a communication failure occurs. After the control unit 200 detects the ACK bit, if there is any other data to be transmitted to the ID chip 35, the control unit 200 continuously communicates with the ID chip 35 as described above. On the other hand, if there is no data to be transmitted to the ID chip 35, the control unit 200 terminates the communication with the ID chip 35.

By the application of the I2C communication, the control unit 200 can serve as a communication-failure determining unit that determines whether communication with the ID chip 35 has been made properly. In this manner, the control unit 200 detects whether a communication error occurs or whether wrong information is written/read out, and thereby determining whether communication with the ID chip 35 has been made properly. Therefore, when a communication failure occurs, the control unit 200 can retry communicate with the ID chip 35 so as to write right information on the ID chip 35 or receive right information from the ID chip 35.

Communication between the control unit 200 and the ID chip 35 is concretely described below with first to fourth examples. For the sake of convenience, each of the ID chips 35Y, 35M, 35C, and 35K is expressed as the ID chip 35 without a color code because the communication with the control unit 200 is identical among the ID chips 35Y, 35M, 35C, and 35K.

Figure 7:
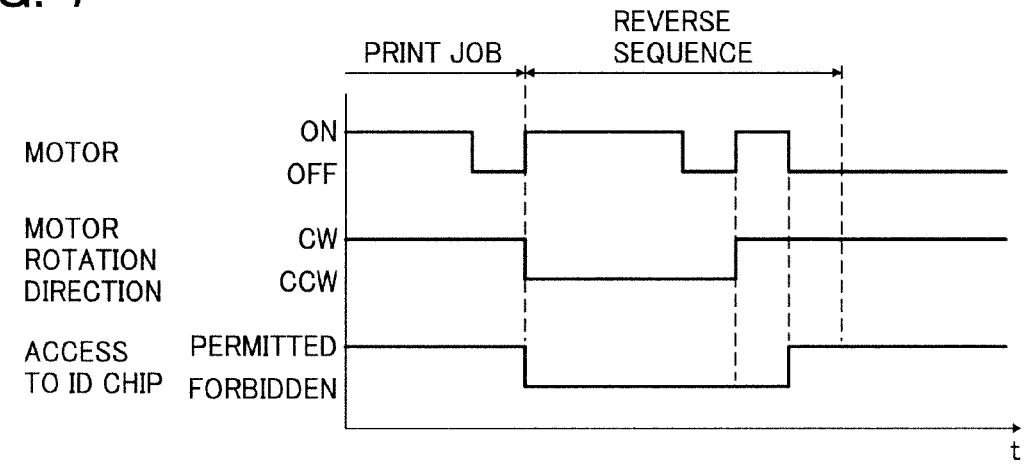
FIG. 7 is a timing chart for explaining timings of stop and resumption of communication with an the ID chip according to a first example.

FIG. 7 is a timing chart for explaining an example where the control unit 200 stops and resumes communication with the ID chip 35 as a first example. During a print job in which the photosensitive drum 2 rotates in the forward direction (in this example, in a clockwise (CW) direction), the control unit 200 is permitted to communicate with the ID chip 35. The control unit 200 communicates with the ID chip 35, and counts a consumed amount of toner, a running distance of the photosensitive drum 2, and the like. Upon completion of the print job, i.e., when the photosensitive drum 2 completely stops rotating, the reverse sequence of causing the photosensitive drum 2 and the intermediate transfer belt 16 to rotate in the reverse direction (i.e., in a counterclockwise (CCW) direction) is started. When the reverse sequence is started, the control unit 200 is forbidden to communicate with the ID chip 35. In other words, while the contact between the communication electrodes 38 and the contact electrodes 94 is unstable due to the CCW rotation of the photosensitive drum 2, the control unit 200 is forbidden to communicate with the ID. Therefore, it is possible to prevent occurrence of an access error and read/write of wrong information. The photosensitive drum 2 and the intermediate transfer belt 16 rotate in the CCW direction for a predetermined time to remove foreign substances from the cleaning blade 3*a* and the intermediate-transfer-belt cleaning blade 21*a*. After that, the CCW rotation of the photosensitive drum 2 and the intermediate transfer belt 16 is stopped, and the photosensitive drum 2 and the intermediate transfer belt 16 rotate in the CW direction for a predetermined time, and then the reverse sequence is terminated. Furthermore, after the elapse of the predetermined time from the start of the CW rotation of the photosensitive drum 2 and the intermediate transfer belt 16, the control unit 200 is permitted to communicate with the ID chip 35, and resumes the communication with the ID chip 35.

In the first example, the control unit 200 resumes the communication with the ID chip 35 after the elapse of the predetermined time from the start of the CW rotation. This is because if abrasion powder or the like is attached to the lower end of the slit 96, the end of the photosensitive-drum shaft 2*a* may be caught in the abrasion powder when the process unit 1 is uplifted. When the end of the photosensitive-drum shaft 2*a* is caught in the abrasion powder, a static friction becomes larger than gravity of the process unit 1. Therefore, even when the CCW rotation of the photosensitive drum 2 is stopped, and a force causing the process unit 1 to be uplifted is not exerted on the process unit 1 any more, the process unit 1 may be still uplifted. Thus, even after the CCW rotation is stopped, it may happen that a contact pressure between the communication electrodes 38 and the contact electrodes 94 is insufficient, thereby causing a contact failure. That's why after the photosensitive drum 2 and the intermediate transfer belt 16 are driven to rotate in the CW direction for the predetermined time, and the process unit 1 is pulled back to the normal position, the control unit 200 resumes the communication with the ID chip 35. In other words, after a sufficient contact pressure between the communication electrodes 38 and the contact electrodes 94 is surely restored, the control unit 200 can communicate with the ID chip 35. Therefore, as compared with a case where the control unit 200 resumes the communication with the ID chip 35 after the CCW rotation of the photosensitive drum 2 is stopped, it is possible to prevent an access error and read/write of wrong information more reliably.

Moreover, the photosensitive drum 2 is driven to rotate in the CW direction for the predetermined time after the CCW rotation of the photosensitive drum 2 is stopped, so that the control unit 200 can communicate with the ID chip 35 while being on stand-to after the reverse sequence.

Figure 8:
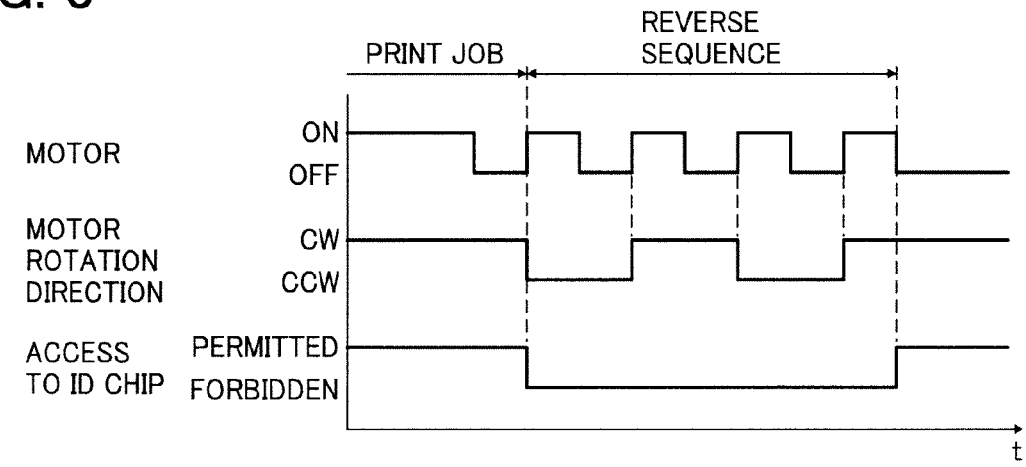
FIG. 8 is a timing chart for explaining timings of stop and resumption of communication with the ID chip according to a second example.

FIG. 8 is a timing chart for explaining another example where the control unit 200 stops and resumes communication with the ID chip 35 as a second example. In the second example, as the reverse sequence, the photosensitive drum 2 is driven to rotate alternately in the CW direction and the CCW direction multiple times. As the number of times of the CCW rotation and the CW rotation increases, the removal of foreign substances can be performed more effectively. However, a user latency and power consumption disadvantageously increase in this case. Therefore, a sequence of the CCW rotation and the CW rotation is preferably performed two to five times continuously.

In the second example, the control unit 200 is forbidden to communicate with the ID chip 35 during the reverse sequence. This is because if the control unit 200 is permitted to communicate with the ID chip 35 while the photosensitive drum 2 rotates in the CW direction in the reverse sequence, the subsequent CCW rotation of the photosensitive drum 2 may be started while the control unit 200 is in communication with the ID chip 35, which may result in an access error or the like.

In the second example, in the same manner as in the first example, the reverse sequence is terminated after the photosensitive drum 2 is driven to rotate in the CW direction. Therefore, when the control unit 200 resumes the communication with the ID chip 35 while being on stand-to after the reverse sequence, a sufficient contact pressure between the communication electrodes 38 and the contact electrodes 94 is surely restored. Therefore, it is possible to prevent an access error and read/write of wrong information reliably.

Figure 9:
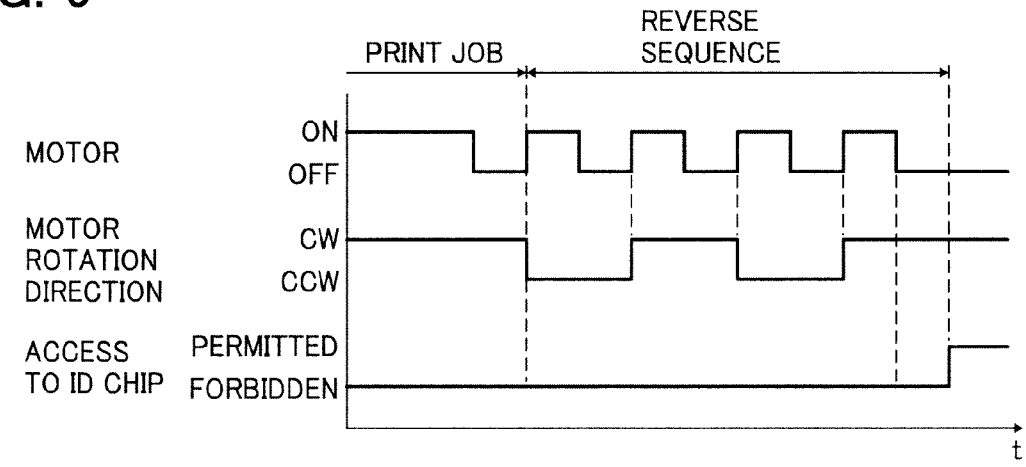
FIG. 9 is a timing chart for explaining timings of stop and resumption of communication with the ID chip according to a third example.

FIG. 9 is a timing chart for explaining still another example where the control unit 200 stops and resumes communication with the ID chip 35 as a third example. As described above, the drive gear 99 and the photosensitive-drum gear 2*b* are configured as a pair of helical gears to reduce a vibration generated by engagement of the gears. If the drive gear 99 and the photosensitive-drum gear 2*b* are not configured as a pair of helical gears, even while the photosensitive drum 2 is driven to rotate in the CW direction, the contact between the communication electrodes 38 and the contact electrodes 94 is unstable due to a vibration generated by engagement of the gears. Furthermore, if a contact pressure between the communication electrodes 38 and the contact electrodes 94 is low, the communication electrodes 38 and the contact electrodes 94 may momentarily draw apart from each other due to the vibration.

Therefore, in the third example, as shown in FIG. 9, while the photosensitive drum 2 is driven to rotate, the control unit 200 is forbidden to communicate with the ID chip 35.

Also, as shown in FIG. 9, the control unit 200 is forbidden to communicate with the ID chip 35 during a print job and during the reverse sequence after completion of the print job. Upon completion of the reverse sequence and when the rotation of the photosensitive drum 2 is stopped, the control unit 200 resumes the communication with the ID chip 35.

Figure 14:
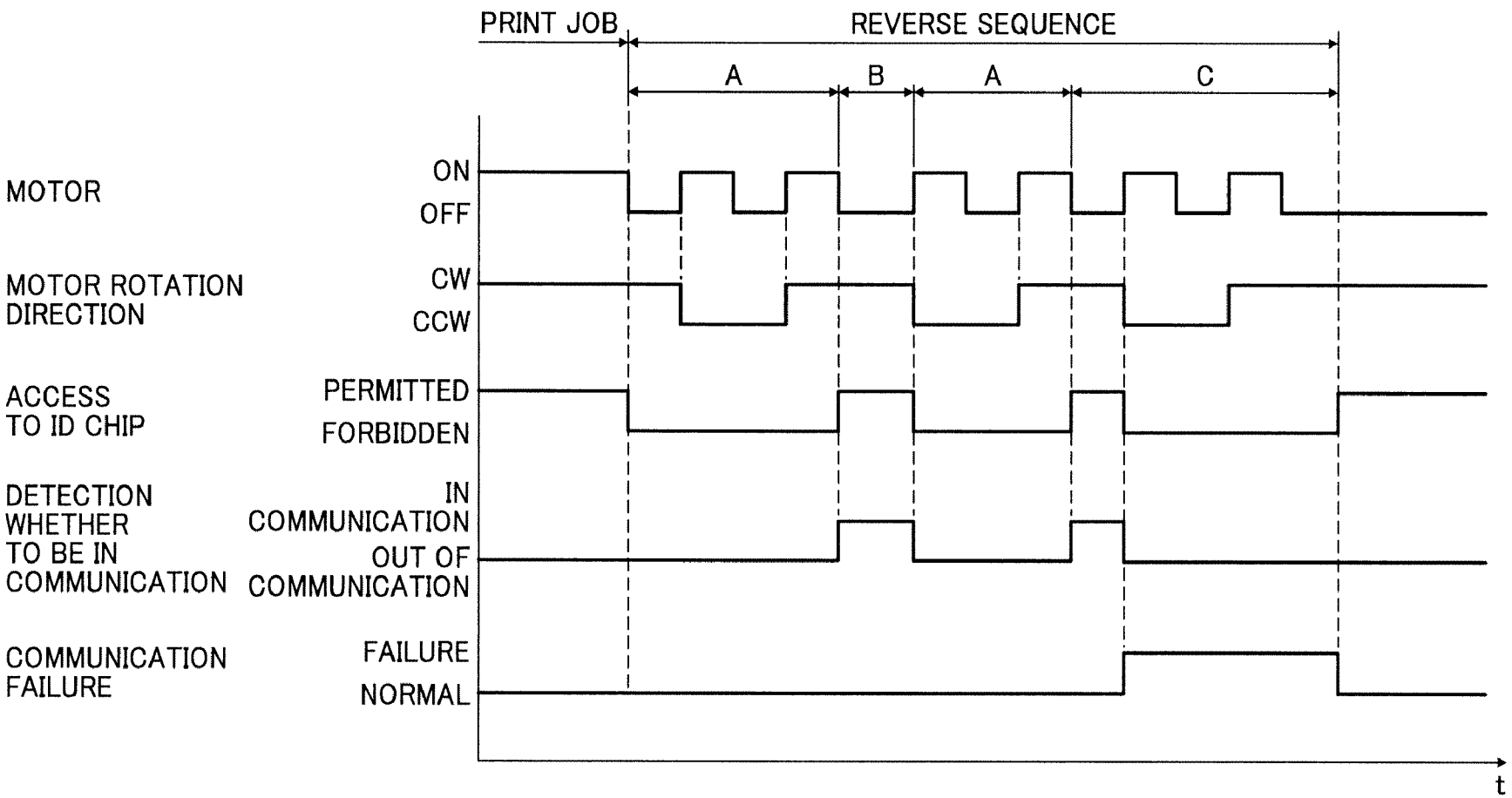
FIG. 14 is a timing chart for explaining timings of stop and resumption of communication with the ID chip according to a fourth example.
Figure 15:
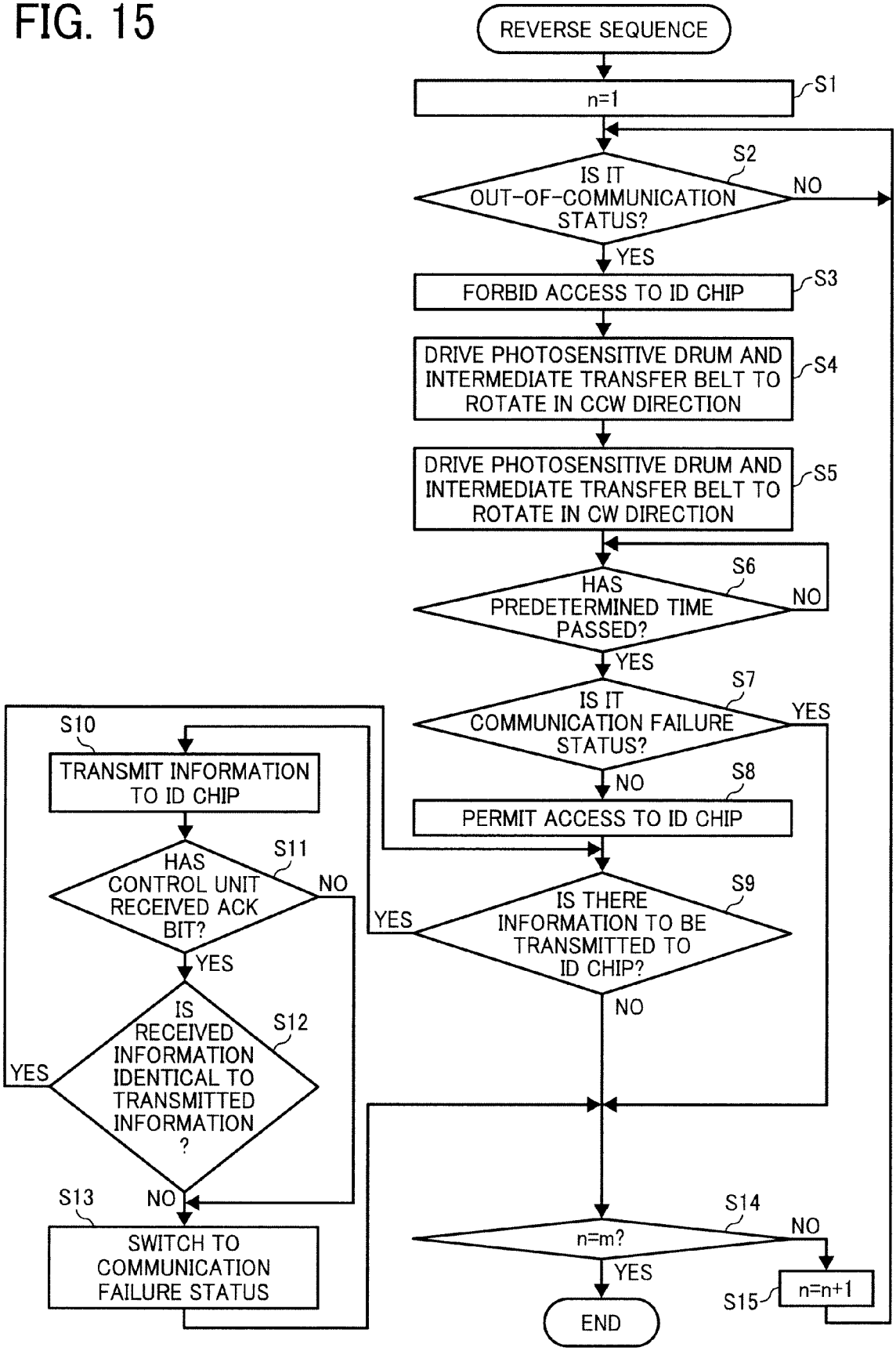
FIG. 15 is a flowchart of a control flow of a control unit of the printer in a reverse sequence in the fourth example.

FIG. 14 is a timing chart for explaining still another example where the control unit 200 stops and resumes communication with the ID chip 35 as a fourth example. FIG. 15 is a flowchart of a control flow of the control unit 200 in the reverse sequence according to the fourth example.

In the fourth example, in the same manner as in the second example, during the reverse sequence in which the photosensitive drum 2 is driven to rotate alternately in the CW direction and the CCW direction multiple times, the control unit 200 stops communication with the ID chip 35, and resumes the communication with the ID chip 35 upon completion of the reverse sequence. When the communication with the ID chip 35 is resumed, and the control unit 200 writes information, such as a running distance of the photosensitive drum 2 during the reverse sequence, on the ID chip 35, the following troubles may occur. For example, if a user powers off the printer during execution of the reverse sequence, the control unit 200 cannot write a running distance of the photosensitive drum 2 during the reverse sequence on the ID chip 35. As a result, the running distance of the photosensitive drum 2 stored in the ID chip 35 is different from an actual running distance of the photosensitive drum 2. Furthermore, if the control unit 200 communicates with the ID chip 35 while the photosensitive drum 2 rotates in the CW direction in the reverse sequence, the subsequent CCW rotation of the photosensitive drum 2 may be started while the control unit 200 is in communication with the ID chip 35, which may result in a communication error or the like.

To avoid such troubles, in the fourth example, the control unit 200 is configured to recognize whether to be in communication with the ID chip 35, and cause a drive motor 80 to rotate in the reverse direction only when the control unit 200 is not in communication with the ID chip 35 after the communication between the control unit 200 and the ID chip 35 is terminated. In other words, in the fourth example, the control unit 200 serves as a communication-status recognizing unit that recognizes whether the control unit 200 as the communicating unit is in communication with the ID chip 35 as the electronic-information storage unit.

Furthermore, in the fourth example, the control unit 200 determines whether the communication between the control unit 200 and the ID chip 35 has been made properly by the I2C communication. If the communication is determined as a communication failure, the control unit 200 stops the communication with the ID chip 35 while the photosensitive drum 2 rotates in the CW direction in the reverse sequence. Namely, in the fourth example, the control unit 200 also serves as a communication-failure determining unit that determines whether communication between the control unit 200 and the ID chip 35 has been made properly.

As shown in FIG. 15, in the fourth example, a variable n is initialized to 1 (Step S1), and when the photosensitive drum 2 and the intermediate transfer belt 16 start rotating in the CCW direction in the reverse sequence, if a communication flag is not set, and the ID chip 35 and the control unit 200 are not in communication (YES at Step S2), the control unit 200 is forbidden to communicate with the ID chip 35 (Step S3), and causes the photosensitive drum 2 and the intermediate transfer belt 16 to be driven to rotate in the CCW direction (Step S4).

When the CCW rotation of the photosensitive drum 2 and the intermediate transfer belt 16 is stopped, the photosensitive drum 2 and the intermediate transfer belt 16 are next driven to rotate in the CW direction for the predetermined time (Steps S5 and S6). The control flow from Step S1 to Step S6 corresponds to a section A in FIG. 14.

After the photosensitive drum 2 and the intermediate transfer belt 16 are driven to rotate in the CW direction for the predetermined time, if a flag indicating a communication failure is not set (NO at Step S7), the control unit 200 is permitted to communicate with the ID chip 35, and transmits information, such as a running distance of the photosensitive drum 2 counted from the start of the reverse sequence until now, to the ID chip 35 (Steps S8 to S10). When the control unit 200 starts communicating with the ID chip 35, the communication flag is set to indicate that the control unit 200 and the ID chip 35 are in communication. Incidentally, the communication between the control unit 200 and the ID chip 35 is made by the I2C communication. Upon receiving the information from the control unit 200, the ID chip 35 transmits the received information with the addition of an ACK bit to the control unit 200. The control unit 200 sets a timer when the control unit 200 transmits the information to the ID chip 35, and monitors whether to receive the ACK bit within a predetermined time (Step S11). When the control unit 200 receives the ACK bit within the predetermined time (YES at Step S11), the control unit 200 compares the information received from the ID chip 35 with the information transmitted to the ID chip 35 to check whether the received information is identical to the transmitted information (Step S12). When the received information is identical to the transmitted information (YES at Step S12), the communication between the control unit 200 and the ID chip 35 has been made properly, so that if there is any other information to be transmitted to the ID chip 35 (YES at Step S9), processes at Steps S10 to S12 are performed.

When no information to be transmitted to the ID chip 35 is left, i.e., the control unit 200 has transmitted all the information to be transmitted to the ID chip 35 (NO at Step S9), the communication flag is turned off to switch to an out-of-communication status, and detects whether a sequence of the CCW rotation and the CW rotation is performed m-times (m=2, in a case shown in FIG. 14) (Step S14). When the sequence of the CCW rotation and the CW rotation is not performed m-times (NO at Step S14), n is incremented by one (Step S15), the flow returns to Step S2. The control flow described above corresponds to a section B in FIG. 14.

On the other hand, when the sequence of the CCW rotation and the CW rotation is performed m-times (YES at Step S14), the reverse sequence is terminated.

Furthermore, when the control unit 200 has not received the ACK bit within the predetermined time (NO at Step S11), or when the information received from the ID chip 35 is not identical to the information transmitted to the ID chip 35 (NO at Step S12), a communication failure occurs, i.e., a communication error or a writing error occurs due to a contact failure between the contact electrodes 94 and the communication electrodes 38. In this case, there is a possibility that the contact failure between the contact electrodes 94 and the communication electrodes 38 again occurs afterwards even while the photosensitive drum 2 rotates in the CW direction in the reverse sequence. Therefore, the control unit 200 sets the flag indicating a communication failure to switch to a communication failure status (Step S13). Therefore, the control unit 200 is forbidden to communicate with the ID chip 35 during execution of the reverse sequence afterwards (corresponding to the control in a section C in FIG. 14). When the communication status is switched to the communication failure status, the communication flag is turned off to switch to the out-of-communication status, thereby being in a state where the photosensitive drum 2 can be driven to rotate in the CCW direction.

In the fourth example, as shown in the section B in FIG. 14, a time from the stop of the CW rotation of the drive motor 80 to the start of the CCW rotation of the drive motor 80 is taken relatively long. This is because, in the fourth example, the control unit 200 is configured not to start the CCW rotation of the drive motor 80 until the communication with the ID chip 35 is terminated. By such a configuration, even when the control unit 200 communicates with the ID chip 35 while the drive motor 80 is driven to rotate in the CW direction in the reverse sequence, the subsequent CCW rotation of the drive motor 80 is not started while the control unit 200 is in communication with the ID chip 35. Therefore, it is possible to prevent a communication error. Furthermore, the control unit 200 communicates with the ID chip 35 while the drive motor 80 is driven to rotate in the CW direction in the reverse sequence, so that even when a user powers off the printer, it is possible to avoid a trouble that a running distance of the photosensitive drum 2 stored in the ID chip 35 is different from an actual running distance of the photosensitive drum 2.

Moreover, in the fourth example, the control unit 200 determines whether communication with the ID chip 35 has been made properly. If a communication failure occurs in the communication, the control unit 200 sets the communication failure flag, and switches to the communication failure status so that the communication with the ID chip 35 cannot be made in the subsequent reverse sequence. Therefore, it is possible to prevent a communication error from occurring in the reverse sequence as much as possible.

Incidentally, when a communication failure occurs during the reverse sequence, the control unit 200 turns off the communication failure flag upon completion of the reverse sequence, and again communicates with the ID chip 35 to transmit information that has been transmitted when the communication error occurred. Alternatively, the control unit 200 can turn off the communication failure flag after the contact between the contact electrodes 94 and the communication electrodes 38 is restored sufficiently by driving the drive motor 80 to rotate in the CW direction upon completion of the reverse sequence. Then, the control unit 200 again communicates with the ID chip 35, and transmits information that has been transmitted when the communication error occurred. At this time, if a communication failure occurs again, the control unit 200 informs the communication failure, for example, by displaying a message indicating the communication failure on a display unit (not shown) of the printer.

In the present embodiment, the tandem color printer employing the intermediate transfer method is used as the image forming apparatus according to the present invention. Alternatively, the present invention can be applied to a monochrome image forming apparatus that includes one photosensitive element, and forms an image in such a manner that a toner image on the photosensitive element is directly transferred onto a recording sheet P. Or, the present invention can be applied to a tandem color image forming apparatus employing a direct transfer method that forms an image in such a manner that toner images formed on a plurality of photosensitive elements are sequentially transferred onto a recording sheet P conveyed on a sheet conveying belt in a superimposed manner.

Furthermore, in the above embodiment, the process unit is attached/detached to the apparatus main body by being slid upward or downward in the vertical direction. Alternatively, it is possible to employ a configuration that the process unit is attached/detached to the apparatus main body by being slid in a horizontal direction. In such a process unit configured to be attached/detached to the apparatus main body with being slid in the horizontal direction, in the same manner as the process unit according to the embodiment, a drive gear provided on the apparatus main body and a photosensitive-drum gear provided on the process unit are configured as a pair of helical gears whose teeth are twisted in a direction so that the both gears come closer to each other while the photosensitive drum is driven to rotate in the forward direction. In a configuration that a contact pressure between communication electrodes and contact electrodes increases while the photosensitive drum is driven to rotate in the forward direction, the process unit moves in a direction of decreasing the contact pressure while the photosensitive drum is driven to rotate in the reverse direction. Therefore, communication with the ID chip is forbidden while the photosensitive drum is driven to rotate in the reverse direction, and thereby preventing an access error or the like.

As described above, the image forming apparatus according to the present embodiment includes a photosensitive element as a latent image carrier and a process unit as an image forming unit that includes a developing unit that develops a latent image on the photosensitive element into a toner image and a cleaning blade as a cleaning unit that removes transfer residual toner from the photosensitive element. The process unit is removably attached to a main body of the image forming apparatus. The image forming apparatus further includes a drive motor as a drive unit that is capable of driving the photosensitive element to rotate in any of a forward direction and a reverse direction. The process unit further includes an ID chip as an electronic-information storage unit that stores therein electronic information, and a communication electrode to be in contact with a contact electrode provided on the main body of the image forming apparatus. The image forming apparatus further includes a control unit as a communicating unit that communicates with the ID chip via an electrical contact between the contact electrode and the communication electrode. The control unit is configured not to communicate with the ID chip while the photosensitive element rotates in the reverse direction. Because a contact failure between the communication electrode and the contact electrode may occur while the photosensitive element rotates in the reverse direction. Therefore, it is possible to prevent an access error or read/write of wrong information.

Furthermore, the control unit can be configured not to communicate with the ID chip while the photosensitive element rotates. Because a communication failure may occur due to a vibration generated by engagement of gears while the photosensitive element rotates. Therefore, it is possible to prevent an access error or read/write of wrong information more reliably.

Moreover, the control unit is forbidden to communicate with the ID chip when the reverse rotation of the photosensitive element is started. Therefore, the control unit is configured not to communicate with the ID chip while the photosensitive element rotates in the reverse direction.

Furthermore, the communication with the ID chip can be permitted after the elapse of a predetermined time from when the drive motor starts driving the photosensitive element to rotate in the forward direction. By the forward rotation of the photosensitive element, a force in a direction of increasing a contact pressure between the communication electrode and the contact electrode is exerted on the process unit. After the process unit moves in the direction of increasing the contact pressure between the communication electrode and the contact electrode sufficiently, the control unit is permitted to communicate with the ID chip. Therefore, as compared with a case where the control unit is permitted to communicate with the ID chip after the reverse rotation of the photosensitive element is stopped, it is possible to prevent an access error or read/write of wrong information more reliably.

Moreover, it is configured that the photosensitive element is driven to rotate in the forward direction just after the reverse rotation of the photosensitive element is stopped. Therefore, the control unit can communicate with the ID chip while being on stand-to after the reverse rotation of the photosensitive element.

Furthermore, as described in the fourth example, the control unit functions as a communication-status recognizing unit that recognizes whether the control unit is in communication with the ID chip. Only when the control unit recognizes that the control unit and the ID chip are out of communication, the drive motor starts driving the photosensitive element to rotate in the reverse direction. Therefore, the drive motor does not drive the photosensitive element to rotate in the reverse direction while the control unit and the ID chip are in communication. Thus, it is possible to avoid disrupting the communication between the control unit and the ID chip. Consequently, it is possible to prevent an access error or read/write of wrong information more reliably.

Moreover, in the present embodiment, when the ID chip receives electronic information from the control unit by the I2C communication, the ID chip is configured to transmit the received electronic information with the addition of an ACK bit as an acknowledgment signal to the control unit. The control unit as a communication-failure determining unit determines whether to receive the ACK bit from the ID chip before the elapse of a predetermined time from when the control unit transmits the electronic information to the ID chip, and also determines whether the electronic information received from the ID chip is identical to the electronic information transmitted to the ID chip. When the control unit receives the ACK bit from the ID chip before the elapse of the predetermined time, and the received electronic information is identical to the transmitted electronic information, the control unit determines that the communication between the control unit and the ID chip has been made properly. On the other hand, when the control unit does not receive the ACK bit from the ID chip even after the elapse of the predetermined time, or when the received electronic information is different from the transmitted electronic information, the control unit determines that a communication failure has occurred in the communication. By such a configuration, the control unit can exactly determine a communication error or a communication failure such that wrong information is written on the ID chip. In addition, the control unit can exactly determine whether the communication with the ID chip has been made properly. Therefore, if the communication with the ID chip failed, the control unit can take an appropriate measure, for example, that the control unit transmits the same information again to the ID chip.

Furthermore, as described in the fourth example, when the control unit determines that a communication failure occurred in communication with the ID chip that has been made while the photosensitive element is driven to rotate in the forward direction in a sequence that the photosensitive element is driven to rotate alternately in the forward direction and in the reverse direction multiple times to remove foreign substances attached to the cleaning blade, communication with the ID chip while the photosensitive element rotates in the forward direction in the subsequent sequence is stopped. Therefore, it is possible to prevent a communication error from occurring in the reverse sequence as much as possible.

Moreover, as described in the second example, communication with the ID chip can be forbidden at the start of the sequence that the photosensitive element is driven to rotate alternately in the forward direction and in the reverse direction multiple times to remove foreign substances attached to the cleaning blade, and communication with the ID chip can be permitted upon completion of the sequence. In this case, as compared with a case where the control unit can communicate with the ID chip while the photosensitive element is driven to rotate in the forward direction in the sequence, it is possible to prevent an access error or read/write of wrong information more reliably.

Furthermore, the sequence is terminated after the photosensitive element is driven to rotate in the forward direction. As a result, after the sequence, the control unit can communicate with the ID chip in good condition.

Moreover, the image forming apparatus further includes an intermediate transfer belt as an intermediate transfer medium onto which a toner image formed on the photosensitive element is transferred and an intermediate-transfer-medium cleaning blade that removes transfer residual toner from the intermediate transfer belt by having contact with the intermediate transfer belt. The intermediate transfer belt is configured to be synchronized with rotation of the photosensitive element. Therefore, when the photosensitive element rotates in the reverse direction, the intermediate transfer belt also rotates in the reverse direction in synchronization with the reverse rotation of the photosensitive element. Thus, it is possible to perform removal of foreign substances from the cleaning blade of the process unit and removal of foreign substances from the intermediate-transfer-medium cleaning blade at the same time.

Furthermore, it is configured that the intermediate transfer belt is driven to rotate by the drive motor that drives the photosensitive element to rotate. Therefore, it is possible to reduce the number of components and a production cost as compared with the one including a drive motor that drives the intermediate transfer belt to rotate separately from the drive motor that drives the photosensitive element to rotate. In addition, it is possible to achieve footprint downsizing because of the single drive motor.

According to an aspect of the present invention, it is possible to prevent a communication error in communication with the electronic-information storage unit and read/write of wrong information from occurring.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier;

an image forming unit that is removably attached to a main body of the image forming apparatus, the image forming unit including at least one of a developing unit that develops a latent image on the latent image carrier into a toner image and a cleaning unit that removes transfer residual toner from the latent image carrier, the image forming unit including an electronic-information storage unit that stores therein electronic information; and a conductive member that makes an electrical contact with the main body when the image forming unit is attached to the main body;

a drive unit that drives the latent image carrier to rotate in any of a forward direction and a reverse direction;

a communicating unit that communicates with the electronic-information storage unit based on an electrical contact between the conductive member and the main body; and a control unit that provides a control so that the communicating does not communicate with the electronic-information storage unit while the latent image carrier is rotating in the reverse direction.

2. The image forming apparatus according to claim 1, wherein the control unit provides a control so that the communicating unit does not communicate with the electronic-information storage unit while the latent image carrier is rotating in the forward direction.

3. The image forming apparatus according to claim 1, wherein when the latent image carrier starts rotating in the reverse direction, the control unit provides a control so that the communicating unit can not communicate with the electronic-information storage unit.

4. The image forming apparatus according to claim 3, wherein after elapse of a predetermined time from when the drive unit starts driving the latent image carrier to rotate in the forward direction, the control unit provides a control so that the communicating unit can communicate with the electronic-information storage unit.

5. The image forming apparatus according to claim 4, wherein the drive unit drives the latent image carrier to rotate in the forward direction just after reverse rotation of the latent image carrier is stopped.

6. The image forming apparatus according to claim 1, wherein the cleaning unit is a cleaning blade, and is arranged to be in contact with the latent image carrier, and the control unit provides a control so that the communicating unit can not communicate with the electronic-information storage unit at start of a sequence that the latent image carrier is driven to rotate alternately in the forward direction and in the reverse direction multiple times to remove foreign substances attached to the cleaning blade, and can communicate with the electronic-information storage unit upon completion of the sequence.

7. The image forming apparatus according to claim 1, further comprising a communication-status determining unit that determines whether the communicating unit and the electronic-information storage unit are in communication, wherein only when the communication-status determining unit determines that the communicating unit and the electronic-information storage unit are out of communication, the control unit allows the drive unit to start driving the latent image carrier to rotate in the reverse direction.

8. The image forming apparatus according to claim 1, wherein when the electronic-information storage unit receives electronic information from the communicating unit, the electronic-information storage unit is configured to transmit received electronic information and an acknowledgment signal to the communicating unit, the image forming apparatus further comprising:

a communication-failure determining unit that determines whether communication between the communicating unit and the electronic-information storage unit has been made properly, wherein when the communicating unit has received the acknowledgment signal from the electronic-information storage unit before elapse of a predetermined time from when the communicating unit transmits the electronic information to the electronic-information storage unit, and also the electronic information received from the electronic-information storage unit is identical to the electronic information transmitted to the electronic-information storage unit, the communication-failure determining unit determines that the communication between the communicating unit and the electronic-information storage unit has been made properly, and when the communicating unit has not received the acknowledgment signal from the electronic-information storage unit even after the elapse of the predetermined time, or when the electronic information received from the electronic-information storage unit is different from the electronic information transmitted to the electronic-information storage unit, the communication-failure determining unit determines that a communication failure has occurred in the communication between the communicating unit and the electronic-information storage unit.

9. The image forming apparatus according to claim 8, wherein the cleaning unit is a cleaning blade, and is arranged to be in contact with the latent image carrier, and when the communication-failure determining unit determines that a communication failure has occurred in communication between the communicating unit and the electronic-information storage unit that has been made while the latent image carrier is driven to rotate in the forward direction in a sequence that the latent image carrier is driven to rotate alternately in the forward direction and in the reverse direction multiple times to remove foreign substances attached to the cleaning blade, the communicating unit is forbidden to communicate with the electronic-information storage unit while the latent image carrier is rotating in the forward direction in subsequent sequence.

10. The image forming apparatus according to claim 6, wherein the sequence is terminated after the latent image carrier is driven to rotate in the forward direction.

11. The image forming apparatus according to claim 9, wherein the sequence is terminated after the latent image carrier is driven to rotate in the forward direction.

12. The image forming apparatus according to claim 1, further comprising:

an intermediate transfer medium onto which the toner image on the latent image carrier is transferred by having contact with the latent image carrier; and an intermediate-transfer-medium cleaning blade that removes transfer residual toner from the intermediate transfer medium by having contact with the intermediate transfer medium, wherein the intermediate transfer medium is configured to be driven to rotate in synchronization with rotation of the latent image carrier.

13. The image forming apparatus according to claim 12, wherein the intermediate transfer medium is driven to rotate by the drive unit.

14. The image forming apparatus according to claim 1, wherein an ID chip is used as the electronic-information storage unit.

* * * * *